US007198676B2

(12) United States Patent
Kiguchi

(10) Patent No.: US 7,198,676 B2
(45) Date of Patent: Apr. 3, 2007

(54) DEVICE MANUFACTURING APPARATUS AND METHOD, AND DRIVING METHOD FOR DEVICE MANUFACTURING APPARATUS

(75) Inventor: Hiroshi Kiguchi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 449 days.

(21) Appl. No.: 10/359,136

(22) Filed: Feb. 6, 2003

(65) Prior Publication Data

US 2004/0079768 A1 Apr. 29, 2004

(30) Foreign Application Priority Data

Feb. 20, 2002 (JP) ..... 2002-043973

(51) Int. Cl.
*B05C 5/02* (2006.01)
*B05D 1/26* (2006.01)

(52) U.S. Cl. ..... 118/696; 118/300; 118/315; 347/1; 347/17

(58) Field of Classification Search ..... 118/679, 118/696, 699, 315, 300; 347/1, 17
See application file for complete search history.

(56) References Cited

U.S. PATENT DOCUMENTS 5,932,012 A * 8/1999 Ishida et al. ..... 118/669
6,419,746 B1 * 7/2002 Banno et al. ..... 118/323

FOREIGN PATENT DOCUMENTS

EP 1 106 356 A1 6/2001
JP 09-052360 2/1997
JP 09-226106 9/1997
JP 10-016211 1/1998
JP 11-020165 1/1999
JP 2001-219556 8/2001

* cited by examiner

*Primary Examiner*—Laura Edwards
(74) *Attorney, Agent, or Firm*—Oliff & Berridge, PLC

(57) ABSTRACT

The present invention provides a device manufacturing apparatus in which a device can be precisely manufactured by stably ejecting a predetermined amount of droplets when the device is manufactured using a droplet ejecting device. The apparatus can include a pressure generation chamber having a Helmholtz resonance frequency of a period TH. A driving signal includes a first signal element to cause the pressure generation chamber to expand, a second signal element to cause the expanded pressure generation chamber to contract, and a third signal element to cause the pressure generation chamber to expand to its original state, which is held before the first signal element is output, after ejection of a droplet. The time which elapses between the beginning of output of the first signal element and the beginning of output of the second signal element, and the time which elapses between the beginning of output of the second signal element and the beginning of output of the third signal element are set to be substantially equivalent to the period TH. The sum of the amplitude of the first signal element and that of the third signal element is set to be substantially equivalent to the amplitude of the second signal element. Accordingly, it is possible to effectively suppress the vibration of a meniscus in the nozzle opening corresponding to the pressure generation chamber.

18 Claims, 14 Drawing Sheets

(a)

(b)

DEVICE MANUFACTURING APPARATUS AND METHOD, AND DRIVING METHOD FOR DEVICE MANUFACTURING APPARATUS

BACKGROUND OF THE INVENTION

1. Field of Invention

The present invention relates to a device manufacturing apparatus and method for manufacturing a device using a droplet ejecting device and a method for driving the device manufacturing apparatus.

2. Description of Related Art

Currently, color filters are used in liquid crystal displays. The color filter is formed so as to be integrated with a liquid crystal display and functions to improve image quality and to give the primary colors to respective pixels. Methods for manufacturing the color filter can include a method for irradiating a film, coated with a photosensitive resin, with light through a photomask to cure irradiated portions, removing unirradiated portions of the film through development to form a pattern, and then coloring the patterned film (coloring method). Additionally, photolithography can be used for manufacture, whereby compositions formed by dispersing red, green, and blue colorants into respective photosensitive resins are sequentially used to form a film, and light irradiation and development are performed in a manner similar to the above method, thus forming a color filter. These methods need various processes, such as film formation, photolithography, and development, resulting in a deterioration in the workability and an increase in the manufacturing cost.

On the other hand, color filter manufacturing methods include a method for forming a colored layer of a color filter using an ink-jet head. According to the method, a position, at which a droplet of a liquid material (ink) including a color-filter forming material is ejected, can be easily controlled, thus reducing waste of the material. Consequently, the manufacturing cost can be reduced.

The ink-jet head has a pressure generation chamber which communicates with a nozzle opening and in which one part of a partition wall is made of an elastic plate. The elastic plate is connected to the movable end of an extensible and contractible piezoelectric vibrator. Accordingly, when the piezoelectric vibrator is expanded or contracted, the volume of the pressure generation chamber can be varied. Thus, the ink can be supplied and the droplet thereof can be ejected.

As an actuator for driving the ink-jet head at high speed, a longitudinal-mode piezoelectric vibrator is used. The piezoelectric vibrator can include piezoelectric-material layers and conductive-material layers which are alternately stacked on each other. The piezoelectric vibrator is extensible in the longitudinal direction thereof. The area of the longitudinal-mode piezoelectric vibrator to be in contact with the pressure generation chamber is smaller than that of a flexural vibration type piezoelectric vibrator. In addition, the longitudinal-mode piezoelectric vibrator can be driven at higher speed than that of the flexural vibration type one. Accordingly, a device can be formed with higher pattern precision.

SUMMARY OF THE INVENTION

The viscosity of an ink including a device forming material is relatively high, the device forming material being used in the formation of a device, for example, the above-mentioned color filter or an electrooptic device such as a liquid crystal device or an organic electroluminescent device. In some cases, when a piezoelectric vibrator is driven at high speed, a predetermined amount of droplet of the ink cannot be ejected because of the high viscosity.

The longitudinal-mode piezoelectric vibrator has a small damping rate in residual vibration. Accordingly, after a droplet is ejected, large residual vibration may be remained and affect the motion of a meniscus. For example, if the portion of the meniscus varies upon ejection of the next droplet, the ejecting direction of the droplet may be fluctuated, resulting in a deterioration in the pattern precision.

The present invention is made in consideration of the above disadvantages. Accordingly, an object of the present invention can be to provide a device manufacturing apparatus and method capable of manufacturing a device such as a color filter or an electrooptic device with high precision by stably ejecting a predetermined amount of droplets in the manufacture of the device using a droplet ejecting device, and a method for driving the device manufacturing apparatus.

To overcome the above disadvantages, according to the present invention, there can be provided a device manufacturing apparatus having a droplet ejecting device including a pressure generation chamber having a variable internal volume and a Helmholtz resonance frequency of a period TH, the device manufacturing apparatus including: a nozzle opening connecting with the inside of the pressure generation chamber. Further the invention can include a driving unit for causing the pressure generation chamber to expand and contract, and a control unit for generating a predetermined driving signal to the driving unit. The control unit can generate a first signal element to cause the pressure generation chamber to expand, a second signal element to cause the expanded pressure generation chamber to contract in order to eject a liquid material in the pressure generation chamber as a droplet from the nozzle opening, and a third signal element to cause the pressure generation chamber to expand to a state, which is held before the first signal element is output, after the ejection of the droplet. The time which elapses between the beginning of output of the first signal element and the beginning of output of the second signal element can be set so as to be substantially equivalent to the period TH. The time which elapses between the beginning of output of the second signal element and the beginning of output of the third signal element can be set so as to be substantially equivalent to the period TH. The sum of the amplitude of the first signal element and the amplitude of the third signal element can be set so as to be substantially equivalent to the amplitude of the second signal element.

According to the present invention, the second signal element is output in phase opposite to that of a residual vibration of the pressure generation chamber expanded in accordance with the first signal element, and the third signal element is output in phase opposite to that of a residual vibration of the pressure generation chamber contracted on the basis of the second signal element. The sum of the expanding and contracting vibrations of the pressure generation chamber based on the three signal elements substantially equals zero. In other words, the first, second, and third signal elements are output with such amplitudes and timings that the vibrations cancel each other out. Therefore, the vibration of the meniscus of the nozzle opening corresponding to the pressure generation chamber can be effectively suppressed, thus realizing stable ejection.

According to the present invention, there can further be provided a device manufacturing apparatus having a droplet ejecting device including a pressure generation chamber having a variable internal volume and a Helmholtz resonance frequency of a period TH. The device manufacturing apparatus can include a nozzle opening connecting with the inside of the pressure generation chamber, a driving unit for causing the pressure generation chamber to expand and contract; and a control unit for generating a predetermined driving signal to the driving unit. The control unit can generate a first signal element to cause the pressure generation chamber to expand, a second signal element to cause the expanded pressure generation chamber to contract in order to eject a liquid material in the pressure generation chamber as a droplet from the nozzle opening, and a third signal element to cause the pressure generation chamber to expand to a state, which is held before the first signal element is output, after the ejection of the droplet. The time which elapses between the beginning of output of the first signal element and the beginning of output of the second signal element is set so as to be substantially equivalent to the period TH. The time which elapses between the beginning of output of the second signal element and the beginning of output of the third signal element is set so as to be substantially equivalent to the period TH. The duration of the first signal element, the duration of the second signal element, and the duration of the third signal element are set so as to be substantially equivalent to each other.

According to the present invention, the second signal element is output in phase opposite to that of a residual vibration of the pressure generation chamber expanded in accordance with the first signal element and the third signal element is output in phase opposite to that of a residual vibration of the pressure generation chamber contracted in accordance with the second signal element. The sum of the expanding and contracting vibrations of the pressure generation chamber based on the third signal elements substantially equals zero. In other words, the first, second, and third signal elements are output with such amplitudes and timings that the vibrations cancel each other out. Therefore, the vibration of the meniscus of the nozzle opening corresponding to the pressure generation chamber can be effectively suppressed, thus realizing stable ejection.

Controlling the duration of each signal element is comparatively easy.

In the device manufacturing apparatus according to the invention, preferably, the control unit outputs the second signal element when the meniscus of the liquid material in the pressure generation chamber turns toward the nozzle opening.

Accordingly, when the meniscus turns toward the nozzle opening, the pressure generation chamber contracts. If the viscosity of the liquid material is high, a droplet can be easily ejected from the nozzle opening with a relatively small driving amount. That is, when the liquid material in the pressure generation chamber is going to shoot out of the nozzle opening due to a residual vibration of the liquid material itself, the pressure generation chamber is further contracted. In other words, the contracting force of the pressure generation chamber is added to the force of the liquid material which is going to shoot out of the nozzle opening. Accordingly, if the driving amount to contract the pressure generation chamber is relatively small, the liquid material can be easily ejected from the nozzle opening. As mentioned above, a droplet can be ejected with a small driving amount using the vibration (overshoot) of the meniscus turning toward the nozzle opening. Therefore, if a high-viscosity liquid material is used, a droplet can be easily ejected by a predetermined amount.

In the device manufacturing apparatus according to the present invention, preferably, the control unit changes the duration of the third signal element. Accordingly, the duration of the third signal element to suppress the vibration of the meniscus is, for example, extended, namely, the expansion rate (the amount of expansion per unit time) of the pressure generation chamber is reduced so that the vibration of the meniscus is not positively suppressed. Thus, as mentioned above, since the state in which the meniscus of the liquid material turns toward the nozzle opening is positively used, if a high-viscosity liquid material is used, a droplet can be ejected by a predetermined amount on the basis of the second signal element. In addition, when the duration of the third signal element is adjusted, the time at which the subsequent second signal element is output can match the time at which the meniscus of the liquid material turns toward the nozzle opening.

In the device manufacturing apparatus according to the present invention, preferably, the control unit changes an initial value of the third signal element. In this case, when an initial value is, for example, lowered to reduce the amount of expansion of the pressure generation chamber based on the third signal element so that the vibration of the meniscus is not positively suppressed, as mentioned above, the state in which the meniscus of the liquid material turns toward the nozzle opening is positively used, so that a droplet of a high-viscosity liquid material can be ejected by a predetermined amount in accordance with the second signal element. In this case as well, the time at which the second signal element is output can match the time at which the meniscus of the liquid material turns toward the nozzle opening.

In the device manufacturing apparatus according to the present invention, the control unit changes the duration of the first signal element. Accordingly, when the duration of the first signal element is, for example, extended, the expansion rate (the amount of expansion per unit time) of the pressure generation chamber can be reduced. Therefore, if the viscosity of a liquid material is, for example, high, the liquid material can be stably retracted into the pressure generation chamber by a predetermined amount. On the other hand, if the viscosity of the liquid material is low and the material can be retracted into the pressure generation chamber at high rate, the duration of the first signal element is reduced, so that the entire ejecting operation of the droplet ejecting device can be performed at high speed.

According to the present invention, preferably, the device manufacturing apparatus further can include a stage for supporting a substrate onto which the droplet is ejected. Accordingly, while a substrate for a device serving as an industrial product is being supported by the stage, a predetermined pattern can be formed on the substrate with high precision.

According to the present invention, preferably, the device manufacturing apparatus further can include a shifting unit for shifting the stage and the droplet ejecting device relative to each other. Accordingly, while the substrate is being scanned so as to correspond to the droplet ejecting device, a pattern can be formed with good workability.

In the device manufacturing apparatus according to the present invention, preferably, the driving unit can have a piezoelectric vibrator. Accordingly, high-speed driving can be realized. Consequently, the droplet ejecting device ejects the liquid material at high speed, thus efficiently manufacturing a device.

In the device manufacturing apparatus according to the present invention, preferably, the piezoelectric vibrator includes a longitudinal-mode piezoelectric vibrator. Accordingly, droplets can be successively ejected at high speed.

In the device manufacturing apparatus according to the present invention, preferably, the droplet ejecting device ejects an electrooptic-device forming material. Accordingly, an electrooptic device such as a liquid crystal device or an organic electroluminescent device can be formed with good workability.

In the device manufacturing apparatus according to the present invention, preferably, the droplet ejecting device ejects a color-filter forming material. Accordingly, a color filter constituting, for example, a liquid crystal device can be formed with good workability.

According to the present invention, there can be provided a device manufacturing method including a step of ejecting a droplet to a predetermined substrate with a droplet ejecting device having a pressure generation chamber and a nozzle opening, the pressure generation chamber having a variable internal volume and a Helmholtz resonance frequency of a period TH, the nozzle opening connecting with the inside of the pressure generation chamber. The method can include the steps of expanding the pressure generation chamber in accordance with a first signal element, contracting the expanded pressure generation chamber in accordance with a second signal element to eject a liquid material in the pressure generation chamber as a droplet from the nozzle opening, and expanding the pressure generation chamber to a state, which is held before the first signal element is output, in accordance with a third signal element after the ejection of the droplet. The time which elapses between the beginning of output of the first signal element and the beginning of output of the second signal element is set so as to be substantially equivalent to the period TH. The time which elapses between the beginning of output of the second signal element and the beginning of output of the third signal element is set so as to be substantially equivalent to the period TH. The sum of the amplitude of the first signal element and the amplitude of the third signal element is set so as to be substantially equivalent to the amplitude of the second signal element.

According to the present invention, the second signal element can be output in phase opposite to that of a residual vibration of the pressure generation chamber expanded in accordance with the first signal element, and the third signal element is output in phase opposite to that of a residual vibration of the pressure generation chamber contracted in accordance with the second signal element. The sum of the expanding and contracting vibrations of the pressure generation chamber based on the three signal elements substantially equals zero. In other words, the first, second, and third signal elements are output with such amplitude and timings that the vibrations cancel each other out. Therefore, the vibration of the meniscus of the nozzle opening corresponding to the pressure generation chamber can be effectively suppressed, thus realizing stable ejection.

According to the present invention, there is further provided a device manufacturing method including a step of ejecting a droplet to a predetermined substrate with a droplet ejecting device having a pressure generation chamber and a nozzle opening, the pressure generation chamber having a variable internal volume and a Helmholtz resonance frequency of a period TH, the nozzle opening connecting with the inside of the pressure generation chamber. The method can include the steps of expanding the pressure generation chamber in accordance with a first signal element, contracting the expanded pressure generation chamber in accordance with a second signal element to eject a liquid material in the pressure generation chamber as a droplet from the nozzle opening, and expanding the pressure generation chamber to a state, which is held before the first signal element is output, in accordance with a third signal element after the ejection of the droplet. The time which elapses between the beginning of output of the first signal element and the beginning of output of the second signal element is set so as to be substantially equivalent to the period TH. The time which elapses between the beginning of output of the second signal element and the beginning of output of the third signal element is set so as to be substantially equivalent to the period TH. The duration of the first signal element, the duration of the second signal element, and the duration of the third signal element can be set so as to be substantially equivalent to each other.

According to the present invention, the second signal element is output in phase opposite to that of a residual vibration of the pressure generation chamber expanded in accordance with the first signal element, and the third signal element is output in phase opposite to that of a residual vibration of the pressure generation chamber contracted in accordance with the second signal element. The sum of the expanding and contracting vibrations of the pressure generation chamber based on the three signal elements substantially equals zero. In other words, the first, second, and third signal elements are output with such amplitudes and timings that the vibrations cancel each other out. Therefore, the vibration of the meniscus of the nozzle opening corresponding to the pressure generation chamber can be effectively suppressed, thus realizing stable ejection. Controlling the duration of each signal element is comparatively easy.

In the device manufacturing method according to the present invention, preferably, the second signal element causes the pressure generation chamber to contract when the meniscus of the liquid material in the pressure generation chamber turns toward the nozzle opening.

Accordingly, when the meniscus turns toward the nozzle opening, the pressure generation chamber contracts. If the viscosity of the liquid material is high, a droplet can be easily ejected from the nozzle opening with a relatively small driving amount. That is, when the liquid material in the pressure generation chamber is going to shoot out of the nozzle opening due to a residual vibration of the liquid material itself, the pressure generation chamber is further contracted. In other words, the contracting force of the pressure generation chamber is added to the force of the liquid material which is going to shoot out of the nozzle opening. Accordingly, if the driving amount to contract the pressure generation chamber is relatively small, the liquid material can be easily ejected from the nozzle opening. As mentioned above, a droplet can be ejected with a small driving amount using the vibration of the meniscus turning toward the nozzle opening. Therefore, if a high-viscosity liquid material is used, a droplet can be easily ejected by a predetermined amount.

In the device manufacturing method according to the present invention, preferably, the vibration characteristics of the liquid material are previously obtained and the second signal element is output on the basis of the obtained result. Accordingly, in accordance with a liquid material, the time at which the meniscus of the liquid material turning toward the nozzle opening can match the time at which the second signal element causes the pressure generation chamber to contract.

In the device manufacturing method according to the present invention, preferably, the duration of the third signal element is changed. Accordingly, the duration of the third signal element to suppress the vibration of the meniscus is, for example, extended, namely, the expansion rate (the amount of expansion per unit time) of the pressure generation chamber is reduced so that the vibration of the meniscus is not positively suppressed. Thus, as mentioned above, since the state in which the meniscus of the liquid material turns toward the nozzle opening is positively used, if a high-viscosity liquid material is used, a droplet can be ejected by a predetermined amount in accordance with the second signal element. In addition, the duration of the third signal element is adjusted, so that the time at which the subsequent second signal element is output can match the time at which the meniscus of the liquid material turns toward the nozzle opening.

In the device manufacturing method according to the present invention, preferably, an initial value of the third signal element is changed. In this case, when an initial value is, for example, lowered to reduce the amount of expansion of the pressure generation chamber based on the third signal element so that the vibration of the meniscus is not positively suppressed, as mentioned above, the state in which the meniscus of the liquid material turns toward the nozzle opening is positively used. Thus, a droplet of a high-viscosity liquid material can be ejected by a predetermined amount in accordance with the second signal element. In this case as well, the time at which the second signal element is output can match the time at which the meniscus of the liquid material turns toward the nozzle opening.

In the device manufacturing method according to the present invention, preferably, the duration of the first signal element is changed. Accordingly, when the duration of the first signal element is, for example, extended, the expansion rate (the amount of expansion per unit time) of the pressure generation chamber can be reduced. Therefore, if the viscosity of a liquid material is, for example, high, the liquid material can be stably retracted into the pressure generation chamber by a predetermined amount. On the other hand, if the viscosity of the liquid material is low and the material can be retracted into the pressure generation chamber at high rate, the duration of the first signal element is reduced, so that the entire ejecting operation of the droplet ejecting device can be performed at high speed.

In the device manufacturing method according to the present invention, preferably, an electrooptic-device forming material is ejected to the substrate. Accordingly, an electrooptic device such as a liquid crystal device or an organic electroluminescent device can be formed with good workability.

In the device manufacturing method according to the present invention, preferably, a color-filter forming material is ejected to the substrate. Accordingly, a color filter constituting, for example, a liquid crystal device can be formed with good workability.

According to the present invention, there can be provided a method for driving a device manufacturing apparatus having a droplet ejecting device including a pressure generation chamber and a nozzle opening, the pressure generation chamber having a variable internal volume and a Helmholtz resonance frequency of a period TH, the nozzle opening connecting with the inside of the pressure generation chamber. The method can include the steps of expanding the pressure generation chamber in accordance with a first signal element, contracting the expanded pressure generation chamber in accordance with a second signal element to eject a liquid material in the pressure generation chamber as a droplet from the nozzle opening, and expanding the pressure generation chamber to a state, which is held before the first signal element is output, in accordance with a third signal element after the ejection of the droplet. The time which elapses between the beginning of output of the first signal element and the beginning of output of the second signal element is set so as to be substantially equivalent to the period TH. The time which elapses between the beginning of output of the second signal element and the beginning of output of the third signal element is set so as to be substantially equivalent to the period TH. The sum of the amplitude of the first signal element and the amplitude of the third signal element is set so as to be substantially equivalent to the amplitude of the second signal element.

According to the present invention, the second signal element is output in phase opposite to that of a residual vibration of the pressure generation chamber expanded in accordance with the first signal element, and the third signal element is output in phase opposite to that of a residual vibration of the pressure generation chamber contracted in accordance with the second signal element. The sum of the expanding and contracting vibration of the pressure generation chamber based on the three signal elements substantially equals zero. In other words, the first, second, and third signal elements are output with such amplitudes and timings that the vibrations cancel each other out. Therefore, the vibration of the meniscus of the nozzle opening corresponding to the pressure generation chamber can be effectively suppressed, thus realizing stable ejection.

According to the present invention, there is further provided a method for driving a device manufacturing apparatus having a droplet ejecting device including a pressure generation chamber and a nozzle opening, the pressure generation chamber having a variable internal volume and a Helmholtz resonance frequency of a period TH, the nozzle opening connecting with the inside of the pressure generation chamber. The method can include the steps of expanding the pressure generation chamber in accordance with a first signal element, contracting the expanded pressure generation chamber in accordance with a second signal element to eject a liquid material in the pressure generation chamber as a droplet from the nozzle opening, and expanding the pressure generation chamber to a state, which is held before the first signal element is output, in accordance with a third signal element after the ejection of the droplet. The time which elapses between the beginning of output of the first signal element and the beginning of output of the second signal element is set so as to be substantially equivalent to the period TH. The time which elapses between the beginning of output of the second signal element and the beginning of output of the third signal element is set so as to be substantially equivalent to the period TH. The duration of the first signal element, the duration of the second signal element, and the duration of the third signal element are set so as to be substantially equivalent to each other.

According to the present invention, the second signal element is output in phase opposite to that of a residual vibration of the pressure generation chamber expanded in accordance with the first signal element, and the third signal element is output in phase opposite to that of a residual vibration of the pressure generation chamber contracted on the basis of the second signal element. The sum of the expanding and contracting vibrations of the pressure generation chamber based on the three signal elements substantially equals zero. In other words, the first, second, and third signal elements are output with such amplitudes and timings that the vibrations cancel each other out. Therefore, the vibration of the meniscus of the nozzle opening corresponding to the pressure generation chamber can be effectively suppressed, thus realizing stable ejection.

In this instance, the droplet ejecting device according to the present invention can include an ink-jet device having an ink-jet head (droplet ejecting head). The ink-jet head of the ink-jet device can quantitatively eject a liquid material according to an ink-jet technology. For example, the device can quantitatively and intermittently drop a liquid material (fluid) of, for example, 1 to 300 nanograms. Since the ink-jet technology is used as the device manufacturing method, a device can be formed in a predetermined pattern with low-cost equipment.

A dispenser device can also be used as the droplet ejecting device.

According to the present invention, the ink-jet technology is described as a piezo-jet technology for ejecting a fluid (liquid material) using a change in the volume of each piezoelectric element. A system for ejecting a fluid due to the sudden vapor generation by heating can also be used.

The fluid includes a medium having such a viscosity that the medium can be ejected (dropped) from a nozzle of an ink-jet head. Either an aqueous medium or an oily medium can be used. If the medium has such mobility (viscosity) that it can be ejected from a nozzle or the like, it is sufficient. If a solid substance is mixed into the medium, the medium can be used so long as the entire medium functions as a fluid. For materials contained in the fluid, in addition to fine particles dispersed in a solvent, a material dissolved by heating at its melting point or higher can also be used. A material obtained by adding dye, pigment, and other functional materials in addition to a solvent can also be used. For the substrate, in addition to a flat substrate, a curved substrate can also be used. It is unnecessary that the hardness of the pattern forming surface of the substrate be high. In addition to glass, plastic, and metal, flexible materials such as a film, paper, or rubber can be used as the pattern forming surface.

According to the present invention, the fluid can include a device forming material, the device serving as an industrial product. The viscosity thereof is in a range of 5 to 20 cps. It is a matter of course that the present invention can be applied to a fluid having viscosity excluded in the above range.

According to the present invention, so long as a device has a material layer which can be formed by a droplet ejecting device, the present invention can be applied to the device. The device includes a color filter or an electrooptic device such as a liquid crystal device or an organic electroluminescent device. The device forming material includes a color-filter forming material or an electrooptic substance such as a liquid crystal material or an organic electroluminescent material.

BRIEF DESCRIPTION OF THE DRAWINGS

The invention will be described with reference to the accompanying drawings, wherein the numerals reference like elements, and wherein.

DETAILED DESCRIPTION OF PREFERRED EMBODIMENTS

Figure 1:
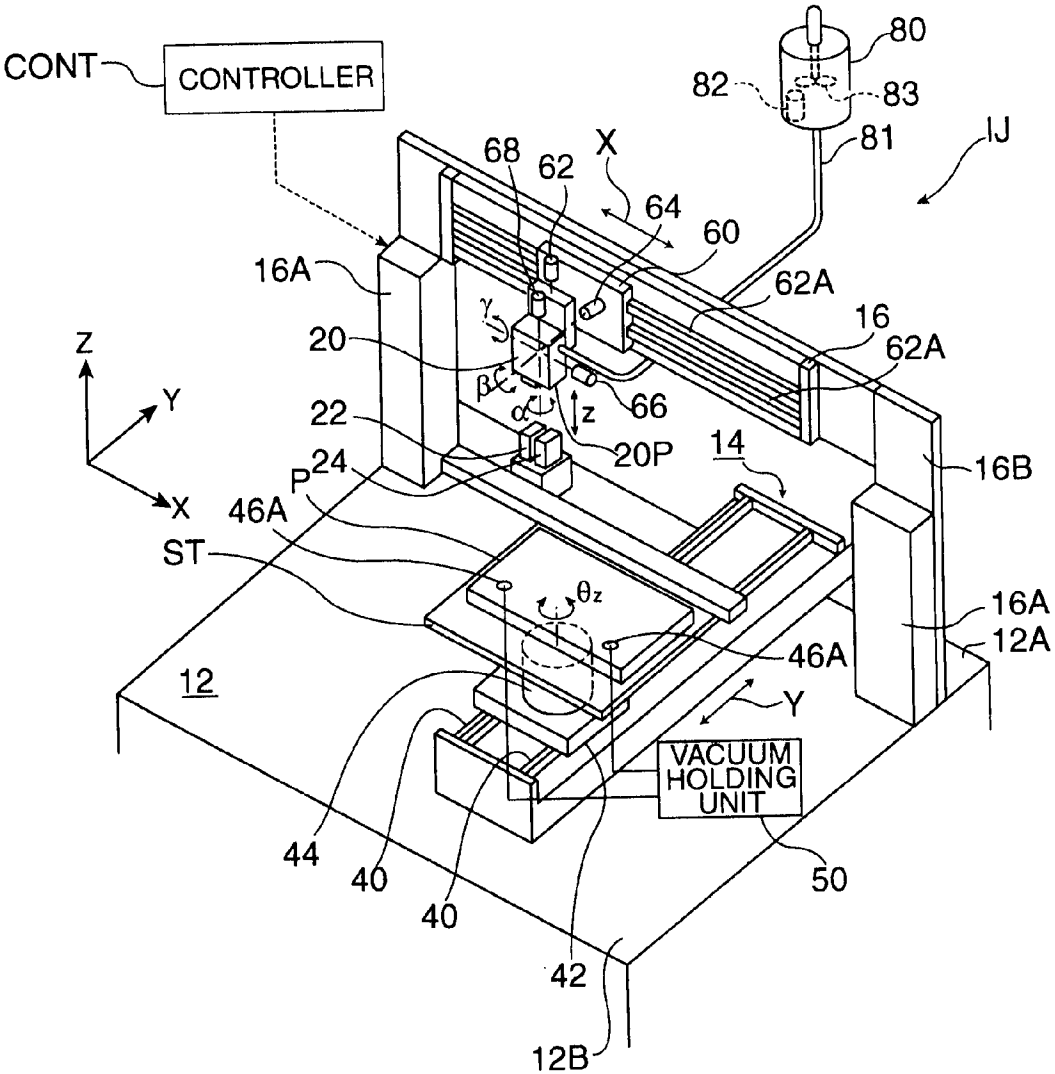
FIG. 1 shows an embodiment of a device manufacturing apparatus according to the present invention, FIG. 1 being a perspective view of a droplet ejecting device as an example.

A device manufacturing apparatus and method, and a method for driving the device manufacturing apparatus according to the present invention will now be described hereinbelow with reference to the drawings. FIG. 1 is a schematic perspective view showing an ink-jet device serving as a droplet ejecting device constituting a device manufacturing apparatus according to the present invention.

Referring to FIG. 1, an ink-jet device (droplet ejecting device) IJ functions as a film forming device in which a liquid material can be set on a substrate P. The device IJ can include a base 12, a stage ST which is disposed above the base 12 and which supports the substrate P, a first shifting unit (shifter) 14 which is interposed between the base 12 and the stage ST and which movably supports the stage ST, an ink-jet head (droplet ejecting unit) 20 which can quantitatively eject (drop) an ink (a liquid material or a fluid) including a predetermined material to the substrate P supported by the stage ST, and a second shifting unit (shifter) 16 which movably supports the ink-jet head 20. An electronic balance (not shown) serving as a weight measuring unit, a capping unit 22, and a cleaning unit 24 are provided on the base 12. A controller CONT controls the operation of the ink-jet device IJ including the ink ejecting operation of the ink-jet head 20 and the shifting operations of the first shifter 14 and the second shifter 16.

In the following explanation, the droplet ejecting device will be described as an ink-jet device. It should be understood that the droplet ejecting device is not especially limited to the ink-jet device. So long as a device ejects a droplet so that a predetermined pattern can be formed on the substrate P using a liquid material, any device can be used. For example, a dispenser device can also be used.

The first shifter 14 can be disposed on the base 12 and is positioned in the Y axial direction. The second shifter 16 is attached to the base 12 so as to stand thereon using struts 16A and 16A. The second shifter 16 is arranged in a back portion 12A of the base 12. The X axial direction (second direction) of the second shifter 16 is perpendicular to the Y axial direction (first direction) of the first shifter 14. The Y axial direction is a direction along a portion between a front portion 12B and the back portion 12A of the base 12. On the other hand, the X axial direction is a direction along the lateral direction of the base 12. The X and Y axial directions are horizontally set. The Z axial direction is perpendicular to the X and Y axial directions.

The first shifter 14 is constructed by, for example, a linear motor. The first shifter 14 comprises guide rails 40 and 40, and a slider 42 provided movably along the guide rails 40. The slider 42 of the linear motor type first shifter 14 can be moved in the Y axial direction along the guide rails 40 and be positioned.

The slider 42 has a motor 44 for rotation around the Z axis (θz). For example, the motor 44 is a direct drive motor. A rotor of the motor 44 is fixed to the stage ST. Consequently, when the motor 44 is energized, the rotor and the stage ST are rotated in the direction θz, so that the stage ST can be induced (rotation indexing). In other words, the first shifter 14 can shift the stage ST in the Y axial direction (first direction) and the direction θz.

The stage ST supports the substrate P and positions it at a predetermined position. The stage ST has a vacuum holding unit 50. When the vacuum holding unit 50 is operated, the substrate P is tightly supported on the stage ST through holes 46A formed in the stage ST by vacuum suction.

The second shifter 16 is constructed by a linear motor. The second shifter 16 comprises columns 16B, which are fixed to the struts 16A and 16A, respectively, guide rails 62A supported by the columns 16B, and a slider 60 movably provided along the guide rails 62A in the X axial direction. The slider 60 can be moved in the X axial direction along the guide rails 62A and be positioned. The ink-jet head 20 is attached to the slider 60.

The ink-jet head 20 has motors, 62, 64, 66, and 68 serving as rotation positioning units. When the motor 62 is operated, the ink-jet head 20 can be longitudinally moved in the Z axis and be positioned. The Z axis is the direction (longitudinal direction) perpendicular to the X and Y axes. When the motor 64 is operated, the ink-jet head 20 can be rotated around the Y axis in the direction β and be positioned. When the motor 66 is operated, the ink-jet head 20 can be rotated around the X axis in the direction γ and be positioned. When the motor 68 is rotated, the ink-jet head 20 can be rotated around the Z axis in the direction α and be positioned. In other words, the second shifter 16 supports the ink-jet head 20 movably in the X axial direction (first direction) and the Z axial direction and also supports the ink-jet head 20 movably in the directions θx, θy, and θz.

As mentioned above, referring to FIG. 1, on the slider 60, the ink-jet head 20 can be moved linearly in the Z axial direction and be positioned and can also be rotated along α, β, and γ and be positioned. The position or attitude of the ink ejecting surface 20P of the ink-jet head 20 can be precisely controlled with respect to the substrate P on the stage ST. A plurality of nozzle openings 2 (refer to FIG. 2), each of which ejects an ink, are formed on the ink ejecting surface 20P of the ink-jet head 20.

According to the present embodiment, the ink-jet head 20 has a structure to cause a change in the volume of each piezoelectric element (piezoelectric vibrator), thus ejecting a liquid material. The following head structure can also be used. In this head structure, a heating element heats a liquid material to cause the material to expand, thus ejecting a droplet.

The electronic balance (not shown) receives, for example, 5000 ink droplets from the nozzles of the ink-jet head 20 in order to measure and manage the weight of one droplet of the ink ejected from each nozzle of the ink-jet head 20. The electronic balance divides the weight corresponding to the 5000 ink droplets by 5000, so that the weight of one ink droplet can be precisely measured. On the basis of the measurement of the ink droplet, the amount of ink droplets ejected from the ink-jet head 20 can be optimally controlled.

The cleaning unit 24 can clean the nozzles of the ink-jet head 20 periodically or at any time during the device manufacturing process or during standby. The capping unit 22 caps the ink ejecting surface 20P so that the ink ejecting surface 20P of the ink-jet head 20 does not dry during the standby during which a device is not manufactured.

When the ink-jet head 20 is shifted in the X axial direction by the second shifter 16, the ink-jet head 20 can be selectively positioned above the electronic balance, the cleaning unit 24, or the capping unit 22. In other words, when the ink-jet based 20 is moved so as to be close to, for example, the electronic balance during the device manufacturing operation, the weight of the ink droplet can be measured. When the ink-jet head 20 is moved above the cleaning unit 24, the ink-jet head 20 can be cleaned. When the ink-jet head 20 is moved above the capping unit 22, the ink ejecting surface 20P of the ink-jet head 20 is capped, thus preventing the surface from drying.

In other words, the electronic balance, the cleaning unit 24, and the capping unit 22 can be arranged close to the rear end of the base 12 just below the moving path of the ink-jet head 20 at a distance from the stage ST. Since the setting operation and the removing operation of the substrate P onto/from the stage ST are performed close to the front end of the base 12, the electronic balance, the cleaning unit 24, and the capping unit 22 do not interfere with the operations.

The substrate P has a pattern formation area, where a pattern is formed, on the upper surface thereof. In order to form a reflection film serving as a pattern, the ink-jet head 20 ejects the ink (liquid material) on the pattern formation area of the substrate P.

The ink contains, for example, an electrooptic-device forming material or a color-filter forming material. The material is imparted using a predetermined solvent and a binder resin to form the ink.

The ink containing the dispersed foregoing material is stored in a tank (liquid-material storage unit) 80. The tank 80 is connected to the ink-jet head 20 through a pipe (flow path) 81. The ink to be ejected from the ink-jet head 20 is supplied from the tank 80 through the pipe 81.

The tank 80 has a temperature controller 82 for controlling a temperature of the ink. The temperature controller 82 comprises a heater. The controller CONT controls the temperature controller 82. The temperature controller 82 controls the ink stored in the tank 80 at a predetermined temperature, thus adjusting the viscosity of the ink to a desired value.

The tank 80 further includes an agitator 83 for agitating the ink stored in the tank 80. The ink is agitated by the agitator 83, so that metal fine particles in the ink are dispersed uniformly.

Further, a pipe temperature controller (not shown) controls the temperature of the ink flowing through the pipe 81 at a predetermined value, thus adjusting the viscosity of the ink. Further, a temperature controller (not shown), provided for the ink-jet head 20, controls the temperature of the ink to be ejected from the ink-jet head 20, thus adjusting the viscosity of the ink to a predetermined value.

In this instance, FIG. 1 shows the one ink-jet head 20. The ink-jet device IJ has a plurality of ink-jet heads 20. The plurality of ink-jet heads 20 eject different kinds of inks or the same kind of ink, respectively. An ink containing a first material is ejected from a first ink-jet head among the ink-jet heads 20 onto the substrate P and is then baked or dried. An ink containing a second material is ejected from a second ink-jet head onto the substrate P and is then baked or dried. The similar processes are performed using the other ink-jet heads. Consequently, a plurality of material layers are formed on the substrate P, thus forming a multilayer pattern.

Figure 2:
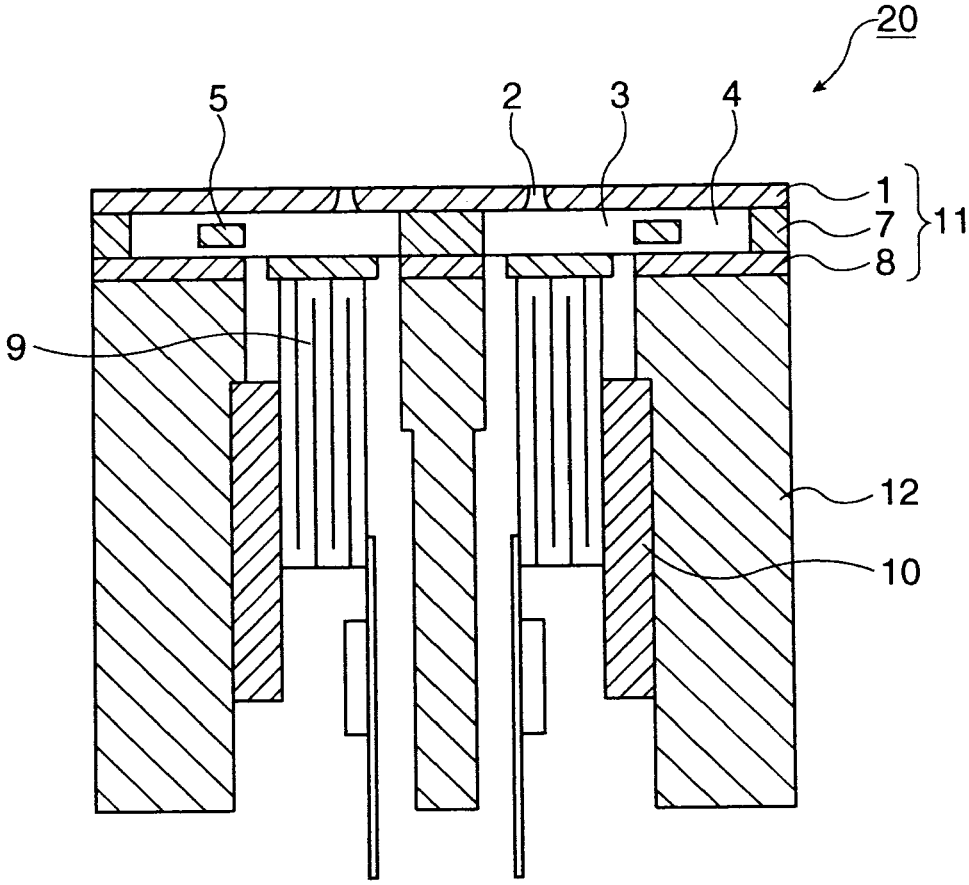
FIG. 2 is a sectional view of a droplet ejection head.

FIG. 2 is a cross sectional view of the ink-jet head 20. As shown in FIG. 2, the ink-jet head 20 can include an ink flow path unit 11 having pressure generation chambers 3, and a head case 12 receiving piezoelectric vibrators 9. The ink flow path unit 11 and the head case 12 are joined with each other. A nozzle plate 1, a flow-path formation plate 7, and an elastic plate 8 are stacked to form the ink flow path unit 11. The nozzle openings 2 are formed in the nozzle plate 1. The pressure generation chambers 3, a common ink chamber 4, and ink supply ports 5, through which the pressure generation chamber 3 communicates with the ink chamber 4, are formed between the nozzle plate 1 and the elastic plate 8. Each nozzle opening 2 connects with the corresponding pressure generation chamber 3.

Each piezoelectric vibrator 9 is a driving unit for expanding and contracting the pressure generation chamber 3. Piezoelectric-material layers and conductive-material layers are alternately stacked on each other in parallel to the longitudinal direction to form the piezoelectric vibrator 9. Therefore, during charge, the piezoelectric vibrator 9 contracts in the longitudinal direction perpendicular to the stacking direction of the conductive layers. During discharge, the piezoelectric vibrator 9 returns to an original state (extends from the contracted state in the longitudinal direction). In other words, the piezoelectric vibrator 9 functions as a longitudinal-mode vibrator. The end (movable end) of the piezoelectric vibrator 9 is joined to the corresponding portion of the elastic plate 8, the portion serving as a section of the pressure generation chamber 3. The other end thereof is fixed to the head case 12 through each base member 10.

In the above-mentioned ink-jet head 20, each pressure generation chamber 3 expands and contracts in accordance with the contraction and extension of the corresponding piezoelectric vibrator 9. Due to a pressure fluctuation of the ink in each pressure generation chamber 3 caused by the expansion and the contraction of the pressure generation chamber 3, the ink is sucked into the pressure generation chamber 3 and the droplet is ejected from the corresponding nozzle opening 2.

According to the present embodiment, when the pressure generation chamber 3 expands, the ink (liquid material) is sucked into the pressure generation chamber 3. On the other hand, when the pressure generation chamber 3 contracts, the ink is ejected as a droplet from the nozzle opening 2.

In this instance, Ci denotes a fluid compliance caused by the contracting properties of the ink in the pressure generation chamber 3, Cv denotes a solid compliance of the material itself of the elastic plate 8, the nozzle plate 1, or the like constituting the pressure generation chamber 3, Mn denotes an inertance of the nozzle opening 2, and Ms denotes an inertance of the ink supply port 5. In the ink-jet head 20 constructed as mentioned above, a Helmholtz resonance frequency FH of the pressure generation chamber 3 can be represented by the following expression:

$$FH=1/(2\pi)\times\sqrt{\{(Mn+Ms)/[(Ci+Cv)\cdot(Mn\times Ms)]\}}$$

A period TH of the Helmholtz resonance frequency can be expressed by the reciprocal (TH=1/FH) of the Helmholtz resonance frequency FH.

When V denotes the volume of the pressure generation chamber 3, ρ denotes the density of the ink, and c denotes a sonic speed in the ink, the fluid compliance Ci can be represented by the following expression:

$$Ci=V/(\rho\times c2)$$

Further, the solid compliance Cv of the pressure generation chamber 3 agrees with a static deformation rate of the pressure generation chamber 3 when a unit pressure is applied to the pressure generation chamber 3.

Specifically, for example, when the pressure generation chamber 3 has a length of 0.5 to 2 mm, a width of 0.1 to 0.2 mm, and a depth of 0.05 to 0.3 mm, the Helmholtz resonance frequency FH is in a range of 50 kHz to 200 kHz and the period TH of the Helmholtz resonance frequency is in a range of 20 μsec to 5 μsec. As a typical example, when the solid compliance Cv is $7.5\times10^{-21}$ [$m^5$/N], the fluid compliance Ci is $5.5\times10^{-21}$ [$m^5$/N], the inertance Mn of the nozzle opening 2 is $1.5\times10^{8}$ [kg/$m^4$], and the inertance Ms of the ink supply port 5 is $3.5\times10^{8}$ [kg/$m^4$], the Helmholtz resonance frequency FH is 136 kHz and the period TH of the Helmholtz resonance frequency is 7.3 μsec.

Figure 3:
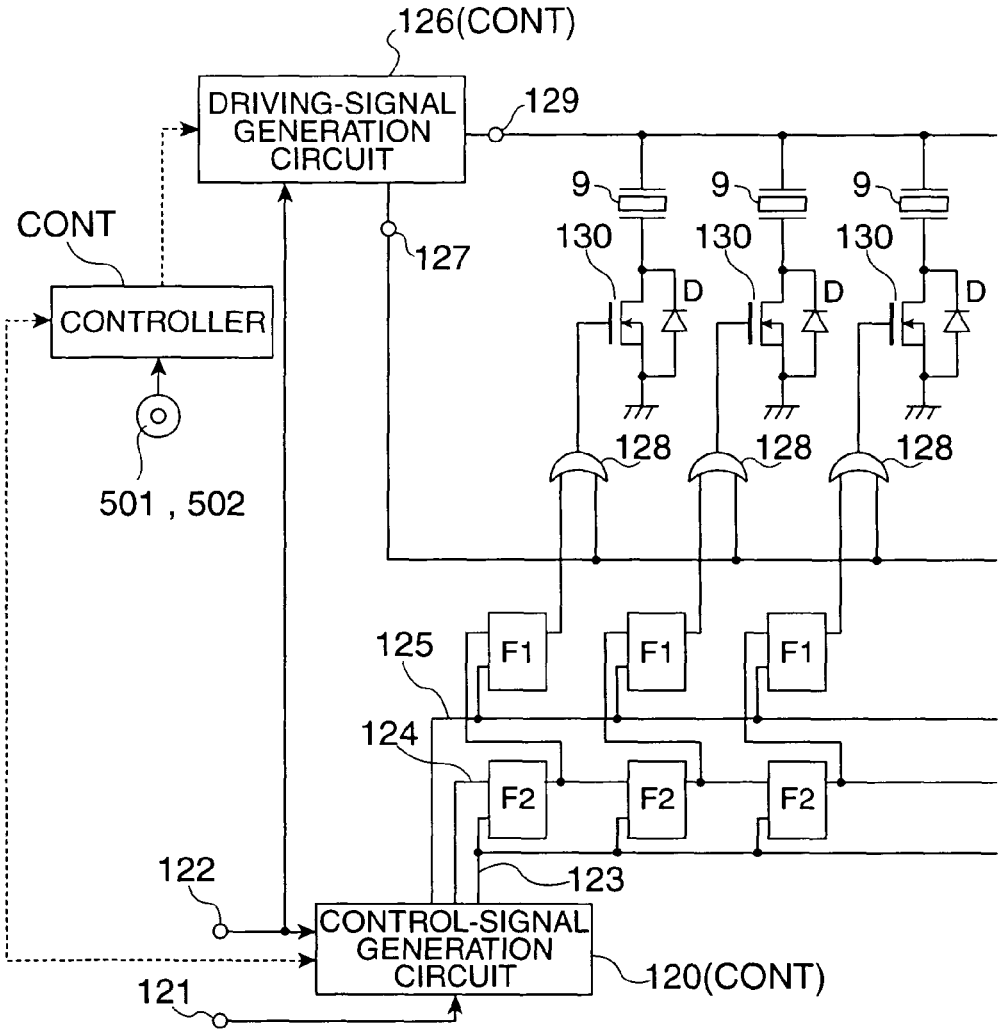
FIG. 3 is a block diagram of an example of a driving circuit of the droplet ejection head.

FIG. 3 shows an example of a driving circuit for driving the above-mentioned ink-jet head 20. As shown in FIG. 3, a control-signal generation circuit 120 (controller CONT) can include input terminals 121 and 122 and output terminals 123, 124, and 125. A pattern signal and a timing signal are supplied from an external device for generating, for example, wiring pattern data for a device to the input terminals 121 and 122. A shift clock signal, a pattern signal, and a latch signal are output from the output terminals 123, 124, and 125, respectively.

A driving-signal generation circuit 126 (controller CONT) outputs a driving signal to drive the piezoelectric vibrator 9 on the basis of the same timing signal supplied from the external device as that input to the input terminal 122.

F1 represents a flip-flop constituting a latch circuit. F2 denotes a flip-flop constituting a shift register. When a signal generated from each flip-flop F2 to the corresponding piezoelectric vibrator 9 is latched by the corresponding flip-flop F1, a selection signal is supplied to each switching transistor 130 through the corresponding OR gate 128.

Figure 4:
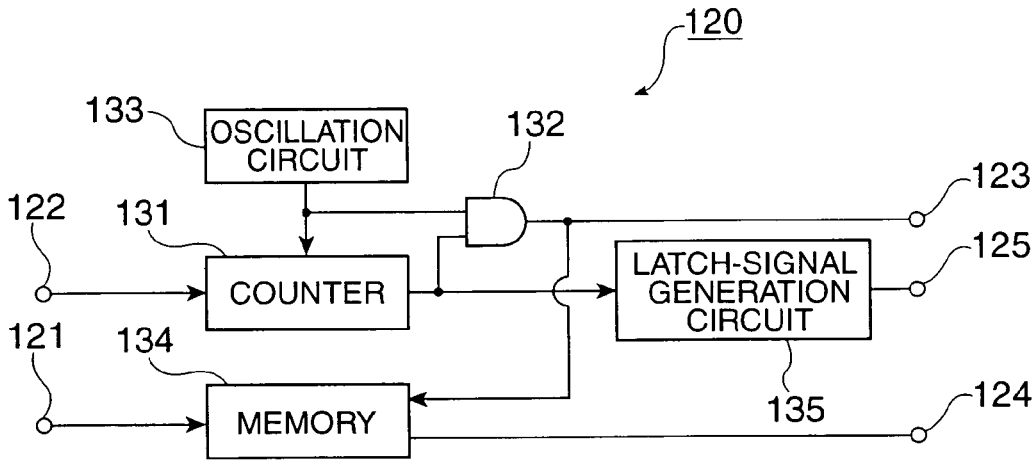
FIG. 4 is an exemplary block diagram of an example of a control-signal generation circuit in FIG. 3.

FIG. 4 shows an example of the control-signal generation circuit 120. As shown in FIG. 4, a counter 131 is initiated at the rising edge of the timing signal (refer to FIG. 6(I)) supplied from the input terminal 122. After the counter 131 is initialized, the counter 131 counts clock signals supplied from an oscillation circuit 133. When a counted value matches the number of piezoelectric vibrators 9 (the number of pressure generation chambers 3 capable of being deformed) connected to an output terminal 129 of the driving-signal generation circuit 126, the counter 131 outputs a carry signal at a low level to stop the counting operation. An AND gate 132 carries out the logical AND between the carry signal of the counter 131 and the clock signal supplied from the oscillation circuit 133. The logical AND is output as a shift clock signal from the output terminal 123.

A memory 134 stores pattern data having the number of bits matching the number of piezoelectric vibrators 9, the pattern data being supplied from the input terminal 121. The memory 134 also has a function of generating the pattern data stored therein to the output terminal 24 in a serial manner, namely, bit by bit synchronously with a signal supplied from the AND gate 132.

Figure 6:
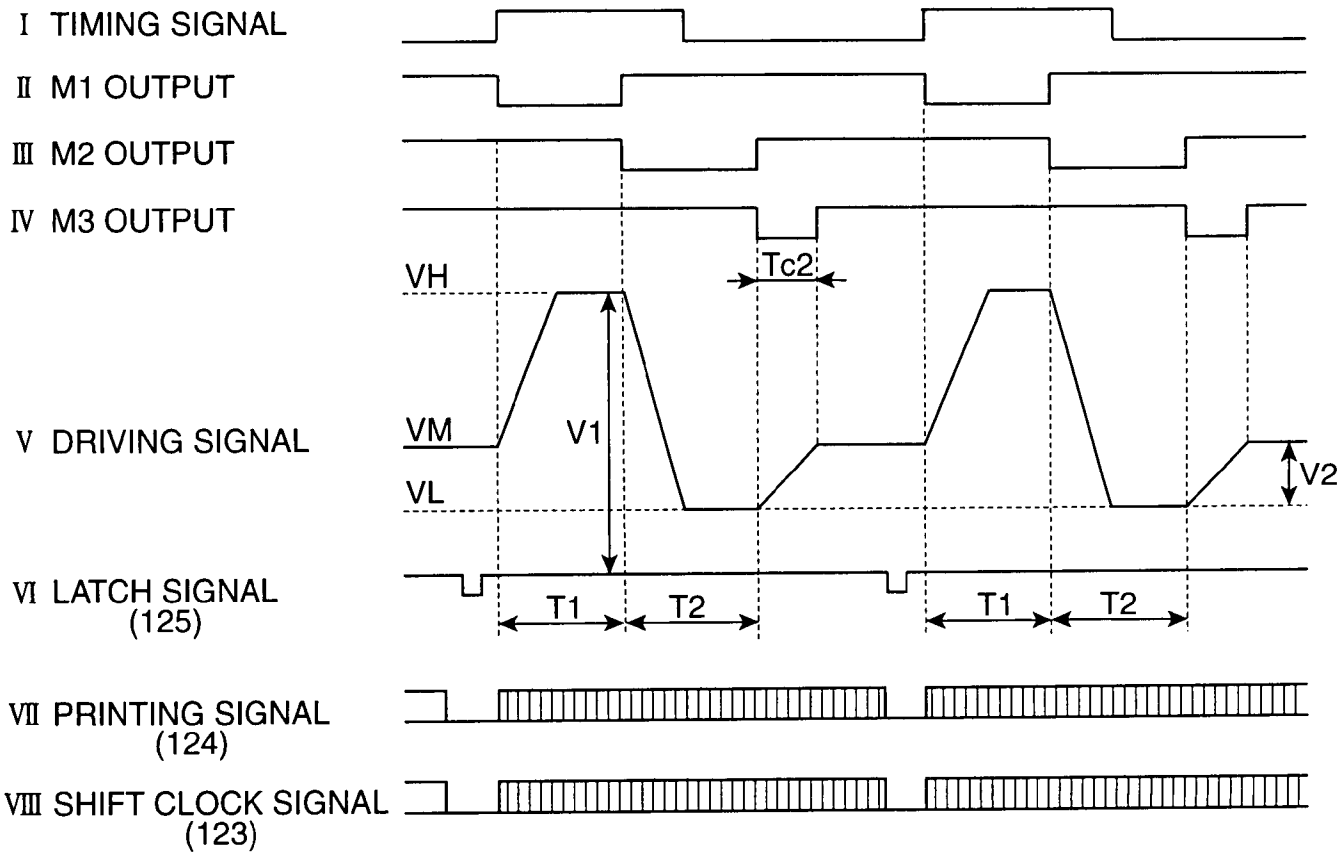
FIG. 6 is a waveform chart showing various signals.

The pattern signal (refer to FIG. 6(VII)) serially transmitted from the output terminal 124 is latched so as to serve as a selection signal for the switching transistor 130 at the next pattern forming period, the pattern signal being latched through the flip-flop F2 (shift register) on the basis of the shift clock signal (refer to FIG. 6(VIII)) output from the output terminal 123 for the pattern signal. The latch signal is generated from a latch-signal generation circuit 135 synchronously with the output of the carry signal at the low level from the counter 131. The time at which the latch signal is output is included in a period during which the driving signal maintains a medium potential VM.

Figure 5:
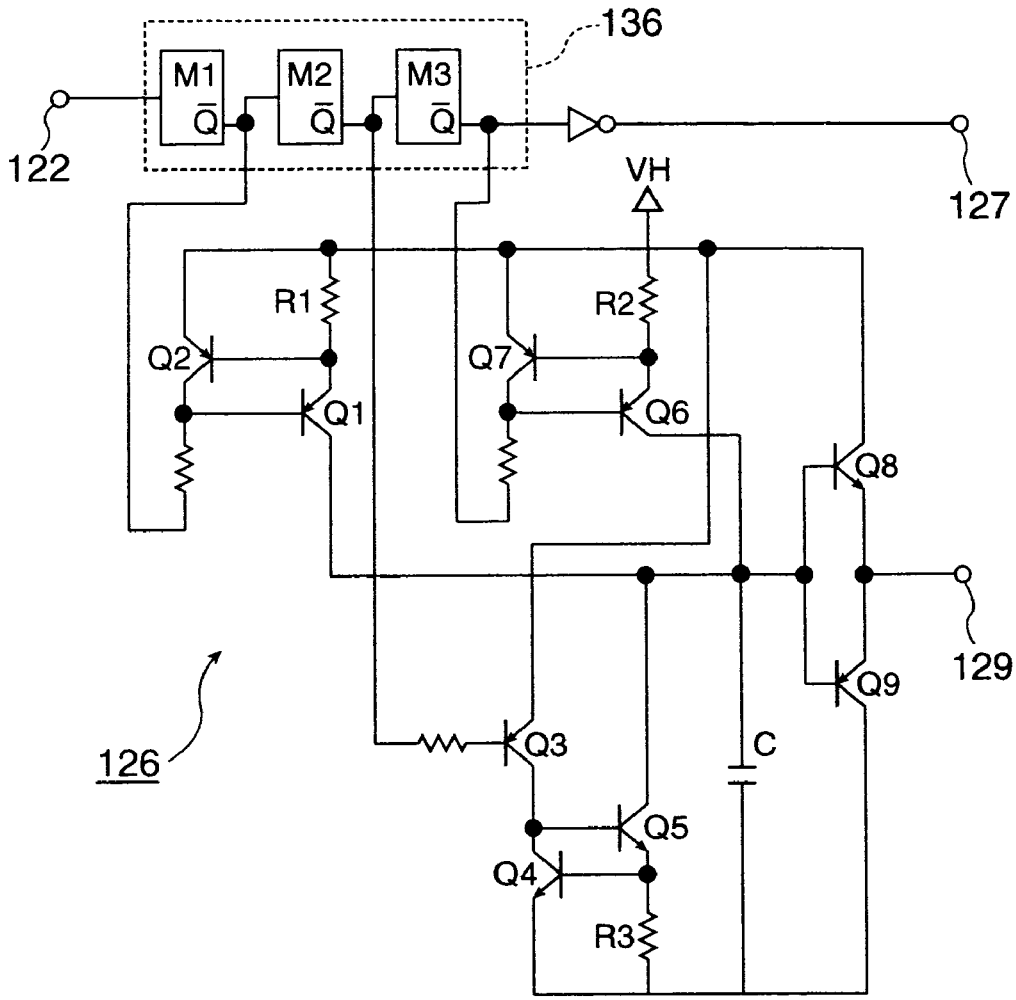
FIG. 5 is an exemplary block diagram of an example of a driving-signal generation circuit in FIG. 3.

FIG. 5 shows an example of the driving-signal generation circuit 126. As shown in FIG. 5, a timing control circuit 136 has three one-shot multivibrators M1, M2, and M3, which are connected in series. A pulse width PW1 (refer to FIG. 6(II)) for determining the sum (T1=Tc1+Th1; refer to FIG. 7) of first charging time (Tc1; refer to FIG. 7) and first holding time (Th1; refer to FIG. 7) is set to the one-shot multivibrator M1, a pulse width PW2 (refer to FIG. 6(III)) for determining the sum (T2=Td+Th2; refer to FIG. 7) of discharging time (Td; refer to FIG. 7) and second holding time (Th2; refer to FIG. 7) is set to the one-shot multivibrator M2, and a pulse width PW3 (refer to FIG. 6(IV)) for determining second charging time (Tc2; refer to FIG. 7) is set to the one-shot multivibrator M3. Reference numeral 127 denotes an output terminal.

As shown in FIG. 5, in response to the rising edges or the falling edges of pulses generated from the one-shot multivibrators M1, M2, and M3, a transistor Q2 to perform charging, a transistor Q3 to perform discharging, and a transistor Q6 to perform second charging are turned on or off.

The driving-signal generation circuit 126 in FIG. 5 will now be described in detail hereinbelow.

When the timing signal is supplied from the external device to the input terminal 122, the one-shot multivibrator M1 outputs a pulse signal (refer to FIG. 6(II)) having the preset pulse width PW1 (Te1+Th1), the one-shot multivibrator M1 constituting the timing control circuit 136 (controller CONT). In response to the pulse signal, a transistor Q1 is turned on. Consequently, a capacitor C, which has already been charged to the potential VM in an initial state, is further charged by a constant current Ic1, which is determined by the transistor Q2 and a resistor R1. When a terminal voltage of the capacitor C is charged to a power supply voltage VH, the charging operation automatically terminates. After that, the voltage of the capacitor C is held until discharging is performed.

After a period (Tc1+Th1=T1) corresponding to the pulse width PW1 of the one-shot multivibrator M1, the pulse signal falls (refer to FIG. 6(II). Consequently, the transistor Q1 is turned off. On the other hand, the one-shot multivibrator M2 outputs a pulse signal (refer to FIG. 6(III)) having the pulse width PW2. In response to this pulse signal, the transistor Q3 is turned on. Thus, the capacitor C is continuously discharged at a constant current Id, which is determined by a transistor Q4 and a resistor R3, until the voltage thereof substantially reaches a voltage VL.

After a period (Td+Th2=T2) corresponding to the pulse width PW2 of the one-shot multivibrator M2, the pulse signal falls (refer to FIG. 6(III)). Thus, the transistor Q2 is turned off. On the other hand, the one-shot multivibrator M3 outputs a pulse signal (refer to FIG. 6(IV)) having the pulse width PW3. In response to the pulse signal, the transistor Q6 is turned on. Consequently, the capacitor C is again charged at a constant current Ic2 to the medium potential VM determined by time (Tc2) corresponding to the pulse width PW3 of the one-shot multivibrator M3. When the voltage of the capacitor C reaches the potential VM, the charging operation terminates.

The above charging and discharging operations cause the generation of the driving signal (FIG. 6(V)) for rising from the medium potential VM to the voltage VH at a constant gradient, holding the voltage VH for the predetermined time Th1, falling to VL at a constant gradient, holding the voltage VL for the predetermined time Th2, and again rising to the medium potential VM, as shown in FIG. 6.

In this instance, in the driving-signal generation circuit 126 shown in FIG. 5, C0 denotes the capacitance of the capacitor C, Rr1 denotes the resistance of the resistor R1, Rr2 denotes the resistance of a resistor R2, Rr3 represents the resistance of the resistor R3, and Vbe2, Vbe4, and Vbe7 denote the base-emitter voltages of the transistors Q2, Q4, and Q7, respectively. The above-mentioned charge current Ic1, the discharge current Id, the charge current Ic2, the charging time Tc1, the discharging time Td, and the charging time Tc2 are expressed by the following expression:

$$Ic1=Vbe2/Rr1$$

$$Id=Vbe4/Rr3$$

$$Ic2=Vbe7/Rr2$$

$$Tc1=C0\times(VH-VM)/Ic1$$

$$Td=C0\times(VH-VL)/Id$$

$$Tc2=C0\times(VM-VL)/Ic2$$

Figure 7:
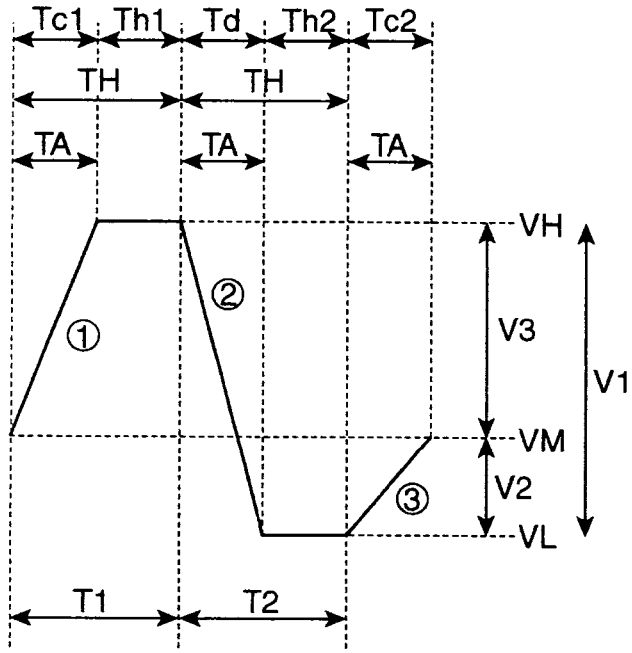
FIG. 7 includes diagrams explaining parameters to specify a driving signal.
Figure 7:
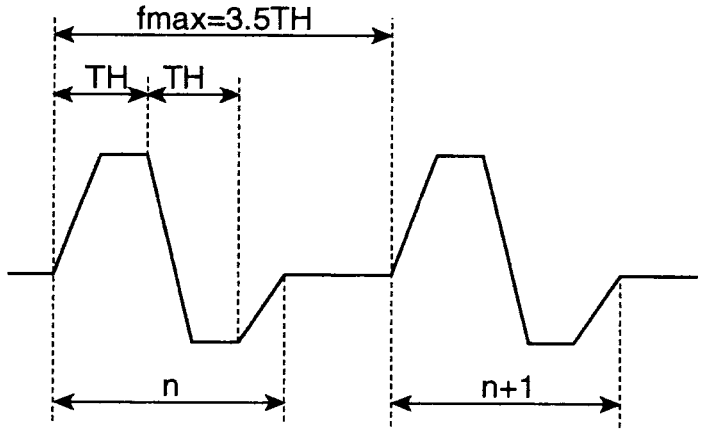

As mentioned above, the longitudinal-mode piezoelectric vibrators 9 are used as the actuators for causing the pressure generation chambers 3 to expand and contract, and the ink is successively ejected under condition that the period of the successive driving signal (generation interval; fmax in FIG. 7(*b*)) is short. Although the pressure generation chambers 3 should not be deformed, in some cases, the pressure generation chambers 3 may be deformed (crosstalk) to cause the meniscuses in the corresponding nozzle openings to vibrate, resulting in unstable ink ejection (based on the driving operations of the subsequent periods) from the nozzle openings.

Therefore, in the ink-jet device IJ, as shown in FIG. 7(*a*), the time which elapses between the beginning of output of a first charge signal element (first signal element) (1) and the beginning of output of a discharge signal element (second signal element) (2), namely, the sum (T1=Tc1+Th1) of the first charging time (Tc1) and the first holding time (Th1) is set so as to be substantially equivalent to the period TH of the Helmholtz resonance frequency.

Further, the time which elapses between the beginning of output of the discharge signal element (2) and the beginning of output of a second charge signal element (3) (third signal element), namely, the sum (T2=Td+Th2) of the discharging time (Td) and the second holding time (Th2) is also set so as to be substantially equivalent to the period TH of the Helmholtz resonance frequency.

Figure 8:
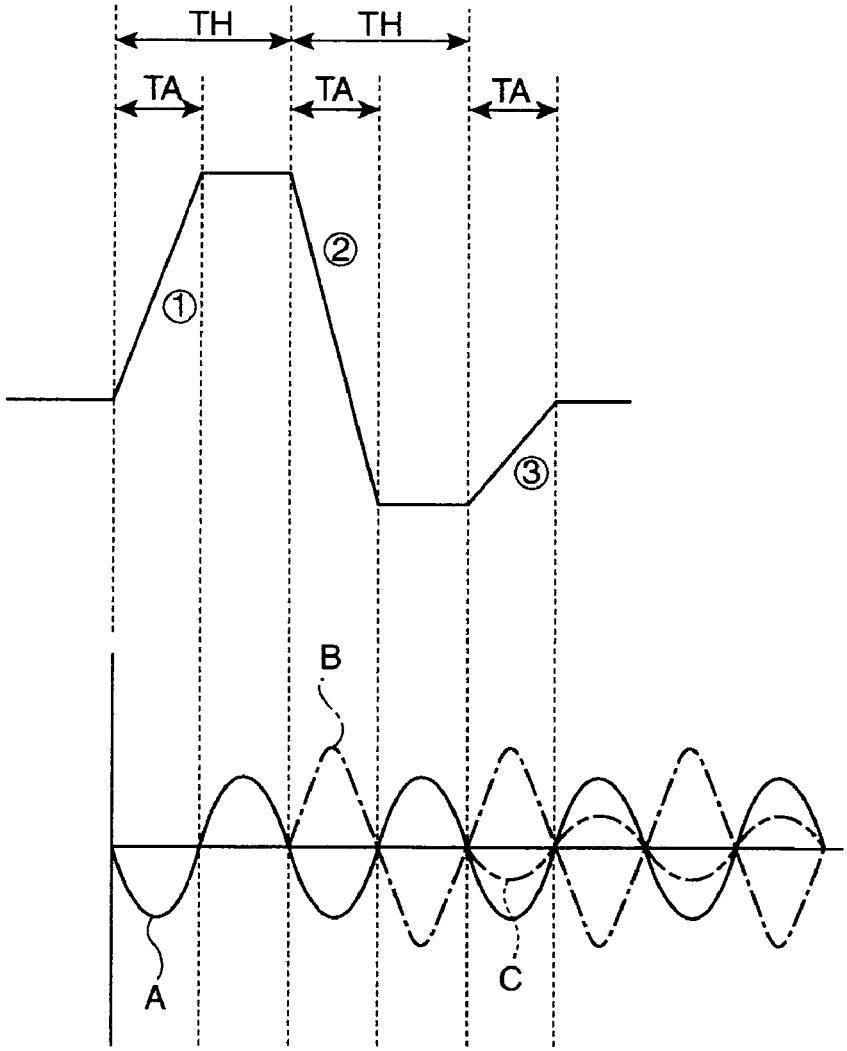
FIG. 8 is a diagram explaining a state where residual vibrations based on three signal elements cancel each other out.

Consequently, as shown in FIG. 8, the discharge element (2) is output in phase opposite to that of a residual vibration A of the expansion caused by the first charge signal element (1), and the second charge signal element (3) is output in phase opposite to that of a residual vibration B of the contraction caused by the discharge signal element (2).

In addition, in the above ink-jet device IJ, the sum of the amplitude of the first charge signal element (1) and that of the second charge signal element (3) is substantially equivalent to the amplitude of the discharge signal element (2). In this case, the duration (Tc1) of the first charge signal element (1), the duration (Td) of the discharge signal element (2), and the duration (Tc2) of the second charge signal element (3) are set so as to be substantially equivalent to each other.

Thus, as shown in FIG. 8, the sum of the amplitudes of the residual vibrations A, B, and C of the pressure generation chamber 3 expanded and contracted by the three signal elements (1), (2), and (3) substantially equals zero.

According to the above structure, in the above ink-jet device IJ, the first charge signal element (1), the discharge signal element (2), and the second charge signal element (3) are generated with such amplitudes and timings that the respective vibrations cancel each other out. Thus, the vibration of the meniscus in the nozzle opening 2 can be effectively suppressed. Therefore, unstable ejection, for example, a fluctuation in the ejecting direction of droplets can be prevented.

In the above ink-jet device IJ, the duration (Tc1) of the first charge signal element (1), the duration (Td) of the discharge signal element (2), and the duration (Tc2) of the second charge signal element (3) are set to as to be substantially equivalent to a proper period TA of the piezoelectric vibrator 9. Consequently, the residual vibration of each piezoelectric vibrator 9 can be suppressed more effectively. Therefore, the residual vibrations of each pressure generation chamber 3 can be effectively suppressed, thus more effectively preventing the unstable ejection of droplets.

In the above ink-jet device IJ, as shown in FIG. 7(*b*), it is preferable to set the period (fmax) of the successive driving signal to be 3.5 times as much as the period TH of the Helmholtz resonance frequency. Consequently, when the driving signals are successively generated to successively eject droplets, a vibration caused by a first driving signal (n) and a vibration caused by a second driving signal (n+1) are output so that the vibrations cancel each other out. Thus, residual vibrations can be suppressed more effectively. In addition, since an interval between successive driving signals is not longer than necessary, the piezoelectric vibrators 9 can be driven with high frequency.

It should be understood that the period fmax of the driving signal is not limited to 3.5 times as much as the period TH of the Helmholtz resonance frequency. The period fmax can be set so as to be substantially equivalent to the sum of a multiple integer of three or more of the period TH of the Helmholtz resonance frequency and ½ the period TH of the Helmholtz resonance frequency. In the theory of the present invention, the period fmax may be 2.5 times as much as the period TH of the Helmholtz resonance frequency. However, in fact, time to switch waveform signals is required between the successive driving signals. Accordingly, it is not preferable to set the period fmax to be 2.5 times as much as the period TH of the Helmholtz resonance frequency.

Furthermore, in the above ink-jet device IJ, it is preferable to set a voltage difference V2 (amplitude) of the second charge signal element (3) to be 0.25 to 0.75 times as much as a voltage difference V1 (amplitude) of the discharge signal element (2). Accordingly, after a droplet is ejected on the basis of the discharge signal element (2), the vibration of the meniscus can be desirably damped by the second charge signal element (3). Consequently, the generation of mist of the ink can be prevented. Thus, droplets can be ejected more stably.

Figure 9:
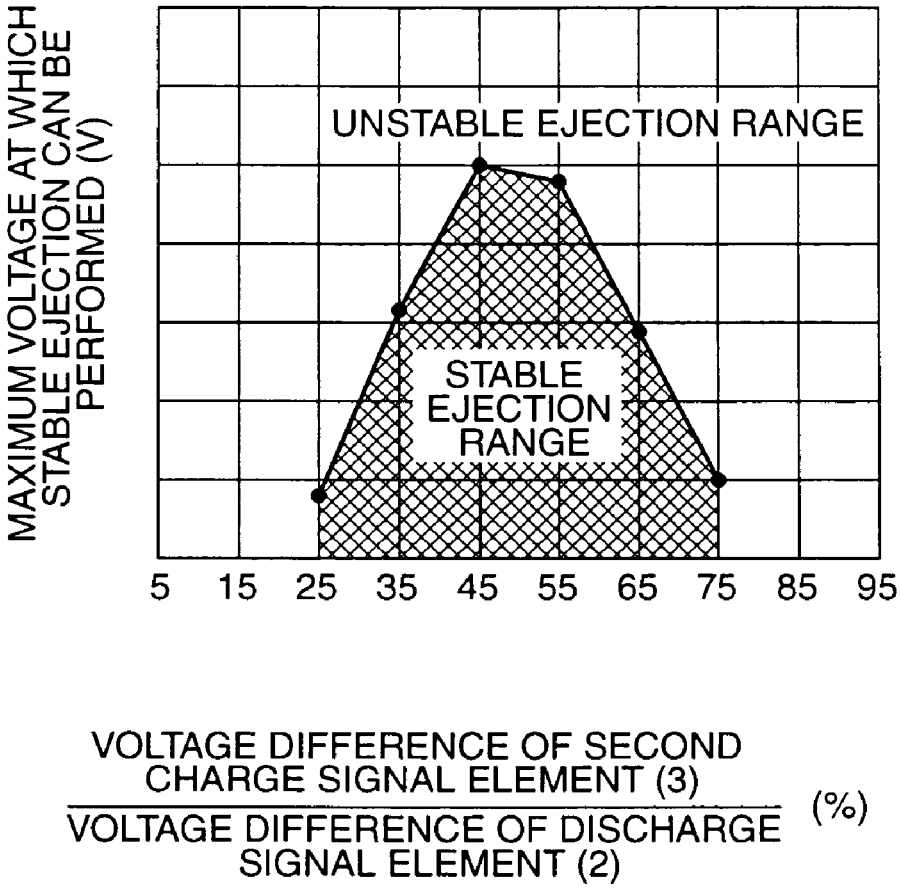
FIG. 9 is a graph showing a relation between the ratio of the voltage difference of a discharge signal element to the voltage difference of a second charge signal element and the maximum voltage at which stable ejection can be performed.

A relation between the ratio of the voltage difference of the discharge signal element (2) to that of the charge signal element (3) and the maximum voltage at which stable ejection can be performed will now be described hereinbelow with reference to FIG. 9.

When the voltage difference V2 of the second charge signal element (3) is smaller than 0.25 times as much as the voltage difference V1 of the discharge signal element (2), it is difficult to sufficiently damp the vibration of the meniscus, caused after ejection of a droplet, with the second charge signal element (3). Accordingly, the subsequent droplets cannot be ejected stably. When the voltage difference V2 of the second charge signal element (3) exceeds 0.75 times as much as the voltage difference V1 of the discharge signal element (2), the meniscus, caused after ejection of a droplet by the discharge signal element (2), is further vibrated. Thus, the droplets cannot be ejected stably. In FIG. 9, it is preferable that the maximum voltage at which stable ejection can be realized indicate a high level, because a voltage can be selected in a wider range.

The operation of the ink-jet device IJ with the above-mentioned structure will now be described hereinbelow.

As mentioned above, the control-signal generation circuit 120 serving as a controller transfers a selection signal for the switching transistors 130 to the flip-flops F1 during the preceding pattern forming period to allow each flip-flop F1 to latch the selection signal for a period during which each piezoelectric vibrator 9 is charged to the medium potential VM. After that, when a timing signal is input, a driving signal shown in FIG. 6(V) rises from the medium potential VM to the voltage VH (first charge signal element (1)), thus charging the piezoelectric vibrator 9. Due to the charging operation, each piezoelectric vibrator 9 contracts at substantially fixed rate, thus causing the corresponding pressure generation chamber 3 to expand.

When the pressure generation chamber 3 expands, the ink in the common ink chamber 4 flows into the pressure generation chamber 3 through the ink supply port 5. Simultaneously, the meniscus of the corresponding nozzle opening 2 retracts into the pressure generation chamber 3. When the driving signal goes to the voltage VH, the voltage VH is held for the predetermined period Th1. After that, the driving signal falls to the potential VL (the discharge signal element (2)). At this time, the discharged signal element (20 is output in phase opposite to that of the residual vibration A of the pressure generation chamber 3 expanded in accordance with the first charge signal element (1).

When the driving signal falls to the potential VL, the piezoelectric vibrator 9 charged at the voltage VH is discharged through a diode D corresponding thereto. Thus, the piezoelectric vibrator 9 extends to cause the corresponding pressure generation chamber 3 to contract. When the pressure generation chamber 3 contracts, the ink is pressurized and is then ejected as a droplet from the nozzle opening 2.

Further, when the vibrating meniscus most retracts into the pressure generation chamber 3 and then turns (starts to return) to the nozzle opening 2, the driving signal again rises from the voltage VL to the medium potential VM (the second charge signal element (3)), thus again charging the piezoelectric vibrator 9. Consequently, the pressure generation chamber 3 slightly expands. At this time, the second charge signal element (3) is output in phase opposite to that of the residual vibration B of the pressure generation chamber 3 contracted on the basis of the discharge signal element (2). When the pressure generation chamber 3 slightly expands, the meniscus, which starts to turn toward the nozzle opening 2, retracts into the pressure generation chamber 3. Consequently, the kinetic energy of the meniscus is reduced, thus rapidly damping the vibration thereof. The sum of the residual vibrations A, B, and C of the pressure generation chamber 3 substantially equals zero, the vibrations caused by the above three signal elements (1), (2), and (3).

As mentioned above, in the above ink-jet device IJ, the first charge signal element (1), the discharge signal element (2), and the second charge signal element (3) are output with such amplitudes and timings that the vibrations cancel each other out. Accordingly, the vibration of each meniscus can be effectively suppressed, thus preventing the unstable ejection of a droplet.

The control-signal generation circuit 120 and the driving-signal generation circuit 126, each of which functions as a controller, can be realized by a computer system. A program for allowing the computer system to function as the above components and a computer-readable recording medium 501 storing the program therein are subjects of protection by the present application.

In addition, if the foregoing components are materialized by a program such as an OS which operates in a computer system, a program including various commands to control the program, such as the OS and a recording medium 502 storing the program therein, are subjects of protection by the present application.

In this instance, the recording media 501 and 502 include a medium that can be recognized as a unit such as a flexible disk or the like and a network through which various signals are transmitted.

Figure 10:
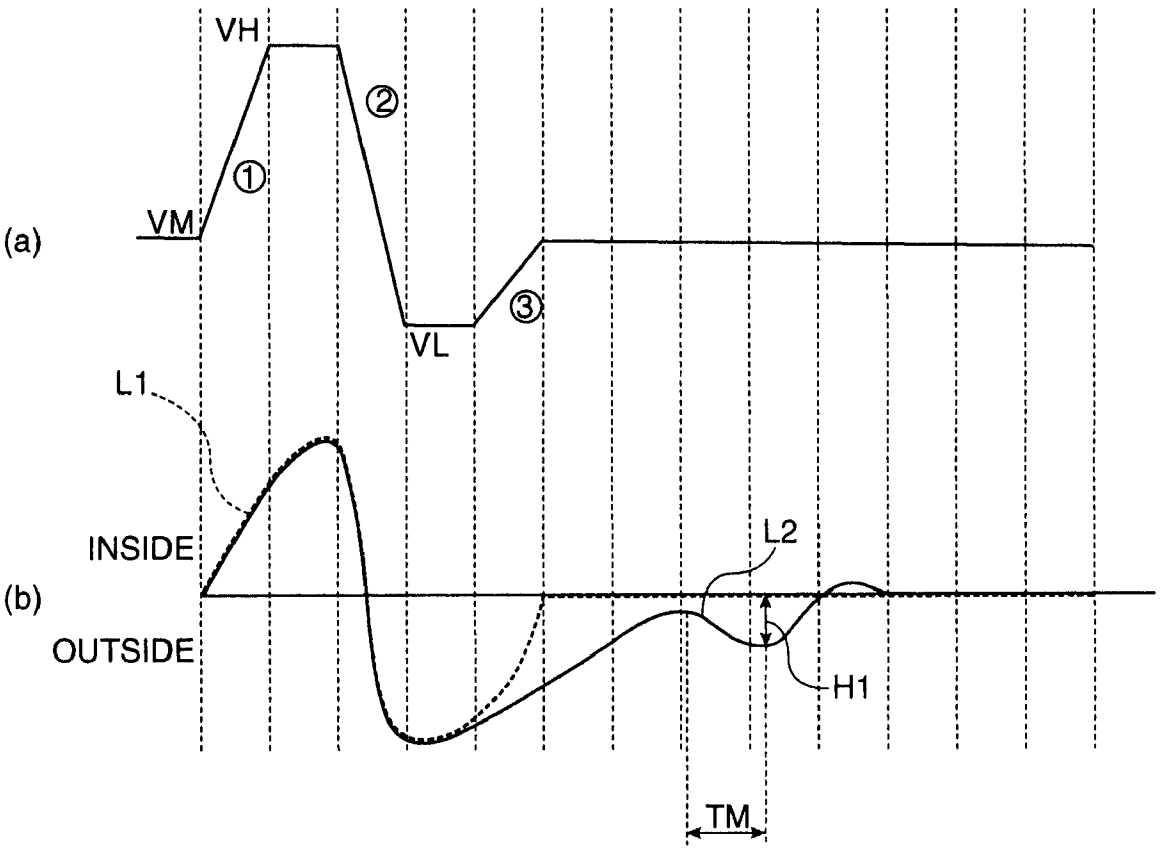
FIG. 10 is a diagram explaining the residual vibrations of the meniscus of a liquid material.

According to a second embodiment, a driving signal to be supplied to each piezoelectric vibrator 9 will now be described hereinbelow with reference to FIGS. 10 and 11. FIG. 10(*a*) shows a driving signal and FIG. 10(*b*) shows the position of a meniscus of an ink (liquid material) in the pressure generation chamber 3.

As shown in FIG. 10(*a*), similar to the driving signal described with reference to FIG. 7, the driving signal comprises the first charge signal element (1) to cause the pressure generation chamber 3 to expand, the discharge signal element (2) to cause the pressure generation chamber 3 to contract to eject the ink, and the second charge signal element (3) to cause the pressure generation chamber 3 to slightly contract in order to damp the residual vibration of the meniscus. When the residual vibration of the meniscus is sufficiently damped in accordance with the second charge signal element (3), the position of the meniscus is displaced as shown by a broken line L1 in FIG. 10(*b*).

On the other hand, when the residual vibration of the meniscus based on the second charge signal element (3) is not sufficiently damped, in other words, when the residual vibration of the meniscus is positively held, the position of the meniscus is displaced as shown by a solid line L2 in FIG. 10(*b*).

Figure 11:
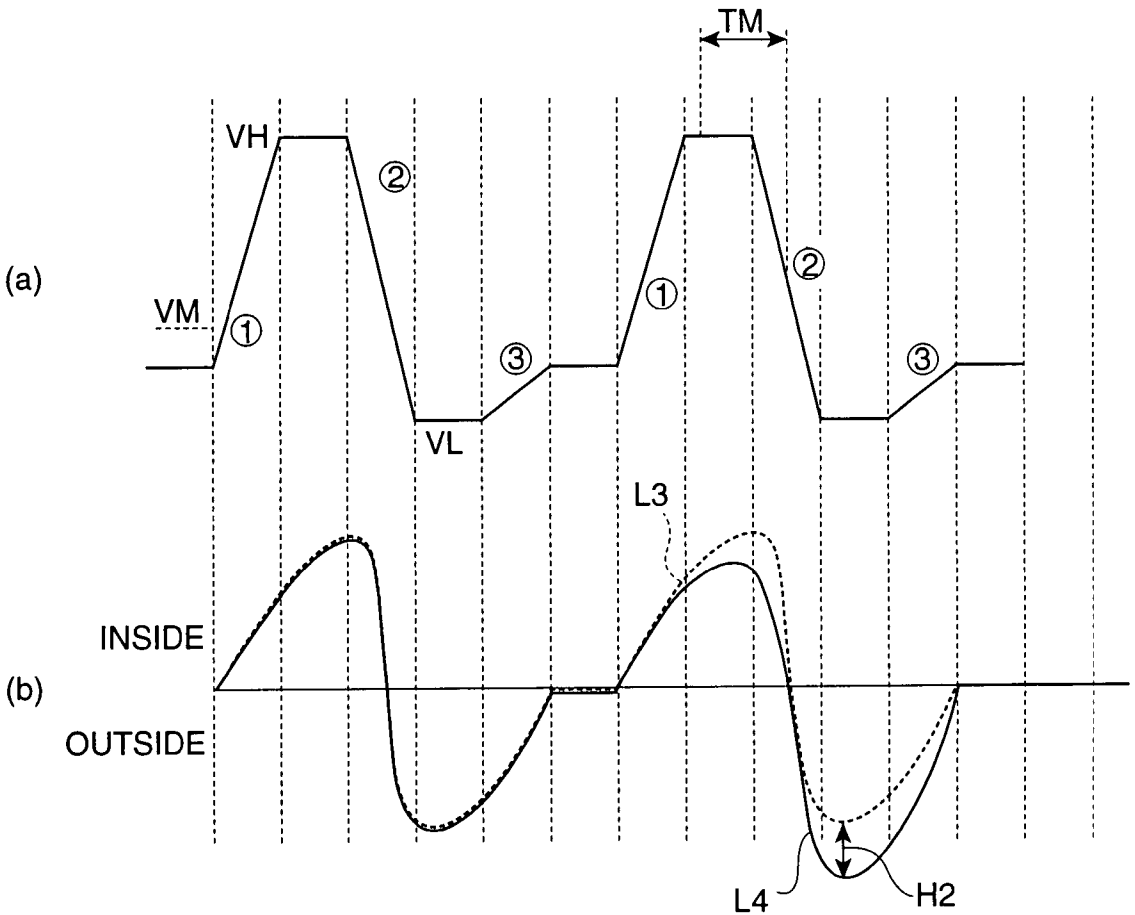
FIG. 11 is a diagram of a driving signal according to a second embodiment.

FIG. 11 is a graph explaining a case where droplets are successively ejected while the residual vibration of a meniscus is being positively held. FIG. 11(*a*) shows a driving signal and FIG. 11(*b*) shows the position of the meniscus. A medium potential in FIG. 11 is set lower than the medium potential VM explained with reference to FIG. 7 or the like. Voltages VH and VL have the same values as those of the foregoing voltages VH and VL. In other words, the voltage difference V1 of the discharge signal element (2) is the same as that in FIG. 7.

The value of the medium potential is reduced, resulting in a decrease in the amplitude V2 of the second charge signal element (third signal element) (3). Thus, the amount of expansion (or expansion rate) of the pressure generation chamber 3 based on the second charge signal element (3) is reduced and the residual vibration of the meniscus is held without being damped. In other words, if the medium potential is reduced, the position of the meniscus is displaced as shown by the solid line L2 in FIG. 10(*b*) so long as the successive ejection is not performed.

After first ejection, if the residual vibration of the meniscus is sufficiently suppressed by the second charge signal element (3), the position of the meniscus upon second ejection is displaced as shown by a broken line L3 in FIG. 11(*b*). In other words, if the residual vibration of the meniscus is sufficiently suppressed, the displacement of the meniscus in the first ejecting operation substantially matches that of the meniscus in the second ejecting operation.

On the other hand, in the case where the residual vibration of the meniscus is positively held, when a period during which the discharge signal element (2) is supplied to the piezoelectric vibrator 9 in the second ejecting operation is set so as to match a period (see reference symbol TM in FIG. 10) during which the meniscus turns toward the nozzle opening on the basis of the residual vibration, a large droplet of the ink can be ejected in the second ejecting operation as shown by a solid line L4 in FIG. 11(*b*).

In other words, the meniscus at this time (state TM) overshoots by displacement H1 as shown in FIG. 10(*b*) and protrudes from the nozzle opening surface. At this time, namely, in such a state where the meniscus of the ink in the pressure generation chamber 3 turns toward the nozzle opening 2, when the discharge signal element (second signal element) (2) is output, the amount of the ink droplet in the second ejection is larger than that in the first ejection by an amount H2 (refer to FIG. 11(*b*)) corresponding to the displacement H1.

At this time, the controller supplies the second charge signal element (2) to the piezoelectric vibrator 9 in the state where the meniscus of the ink in the pressure generation chamber 3 turns toward the nozzle opening 2, thus causing the pressure generation chamber 3 to contract.

As mentioned above, when the ink in the pressure generation chamber 3 is just going to rush out of the nozzle opening 2 by the residual vibration thereof, the pressure generation chamber 3 is further contracted. In other words, the contracting force of the pressure generation chamber 3 is added to the force of the ink rushing out of the nozzle opening 2. Consequently, if the driving amount of the piezoelectric vibrator to allow the pressure generation chamber 3 to contract is comparatively small, a large ink droplet can be easily ejected from the nozzle opening 2.

As mentioned above, in order to maintain the kinetic energy of the meniscus turning toward the nozzle opening 2, the operation for allowing the pressure generation chamber 3 to slightly expand after ejection of the ink is relieved. In other words, the amount of expansion of the pressure generation chamber 3 based on the second charge signal element (3), or the expansion rate (the amount of expansion per unit time) of the pressure generation chamber 3 based on the second charge signal element (3) is reduced.

To reduce the expansion amount of the pressure generation chamber 3 based on the second charge signal element (3), as mentioned above, it is recommended that the amplitude V2 of the second charge signal element (second signal element) (3) be reduced. Specifically, it is recommended that the value of the medium potential VM be reduced. In other words, it is recommended that the initial value (namely, the medium potential VM) of the second charge signal element (third signal element) (3) be changed.

To reduce the expansion rate of the pressure generation chamber 3 based on the second charge signal element (3), it is recommended that the duration of the second charge signal element (third signal element) (3) be extended.

In this manner, the function of reducing the kinetic energy of the meniscus caused by the slight expanding operation of the pressure generation chamber 3 based on the second charge signal element (3) is relieved. Thus, the predetermined kinetic energy of the meniscus can be held.

According to the present embodiment, it can be necessary to allow the time at which the meniscus turns toward the nozzle opening to match the time at which the discharge signal element (2) is output. In this instance, the frequency of the meniscus depends on the natural frequency of the pressure generation chamber 3 and that of the piezoelectric vibrator 9. Therefore, the vibration characteristics of the ink are previously obtained by experiment or numerical calculation. On the basis of the obtained result, desirably, the time at which the discharge signal element (2) is output is set so that the ink is ejected when the meniscus turns toward the nozzle opening 2. Timing can also be set by experiment or numerical simulation.

When the duration of the second charge signal element (3) or the medium potential VM is controlled, the time at which the subsequent discharge signal element (2) is output can be controlled. Thus, it is possible to allow the time at which the pressure generation chamber 3 is contracted to match the time at which the meniscus of the ink turns toward the nozzle opening 2.

As described above, when the meniscus turns toward the nozzle opening 2, the pressure generation chamber 3 is contracted on the basis of the discharge signal element (2). Consequently, if the ink has high viscosity, the droplet can be easily ejected from the nozzle opening 2 by a desired amount with a comparatively small driving amount. In other words, the droplet can be ejected by the desired amount with the small driving amount using the vibration of the meniscus turning toward the nozzle opening 2. Therefore, if a high-viscosity ink is used, a droplet can be easily ejected by a predetermined amount.

In addition, the medium potential VM is reduced, namely, the voltage difference V2 is decreased to reduce the amount of expansion of the pressure generation chamber 3 based on the second charge signal element (3), thus preventing the positive vibration suppression in the meniscus. Consequently, even when the ink has high viscosity, a droplet can be ejected by a predetermined amount positively using the state of the meniscus turning toward the nozzle opening 2.

On the other hand, the duration of the second charge signal element (3) is extended, namely, the expansion rate (the amount of expansion per unit time) of the pressure generation chamber 3 is reduced so that the vibration of the meniscus is not positively suppressed. In this manner, if a high-viscosity ink is used, a droplet can be ejected by a predetermined amount positively using the state of the meniscus of the ink turning toward the nozzle opening.

If the retraction rate (the amount of retraction per unit time) of an ink into the pressure generation chamber 3 based on the first charge signal element (1) is high, a high-viscosity ink for industry products cannot sufficiently follow the retraction rate, so that the desired amount of ink is not retracted into the pressure generation chamber 3. In some cases, the natural vibration period TH of the ink-jet head 20 may vary depending on a manufacturing error. Thus, the amount of retracted ink may vary every ink-jet head.

In this case, the duration of the first charge signal element (first signal element) (1) is extended to reduce the expansion rate (the amount of expansion per unit time) of the pressure generation chamber 3 based on the first charge signal element (1), namely, the retraction rate of the ink into the pressure generation chamber 3. In other words, the ink is slowly retracted. Thus, if the ink has high viscosity, the ink can be stably retracted into the pressure generation chamber 3 by a predetermined amount. Therefore, the ink is retracted by a predetermined amount and, after that, the stable ejecting operation can be performed.

If an ink has low viscosity and the retraction rate of the ink into the pressure generation chamber 3 can be increased, the duration of the first charge signal element (1) is reduced, so that the ejecting operation of the entire ink-jet device IJ can be performed at higher speed. Thus, the throughput can be increased.

A procedure of manufacturing a color filter on the basis of the foregoing device manufacturing method will now be described hereinbelow.

Figure 12:
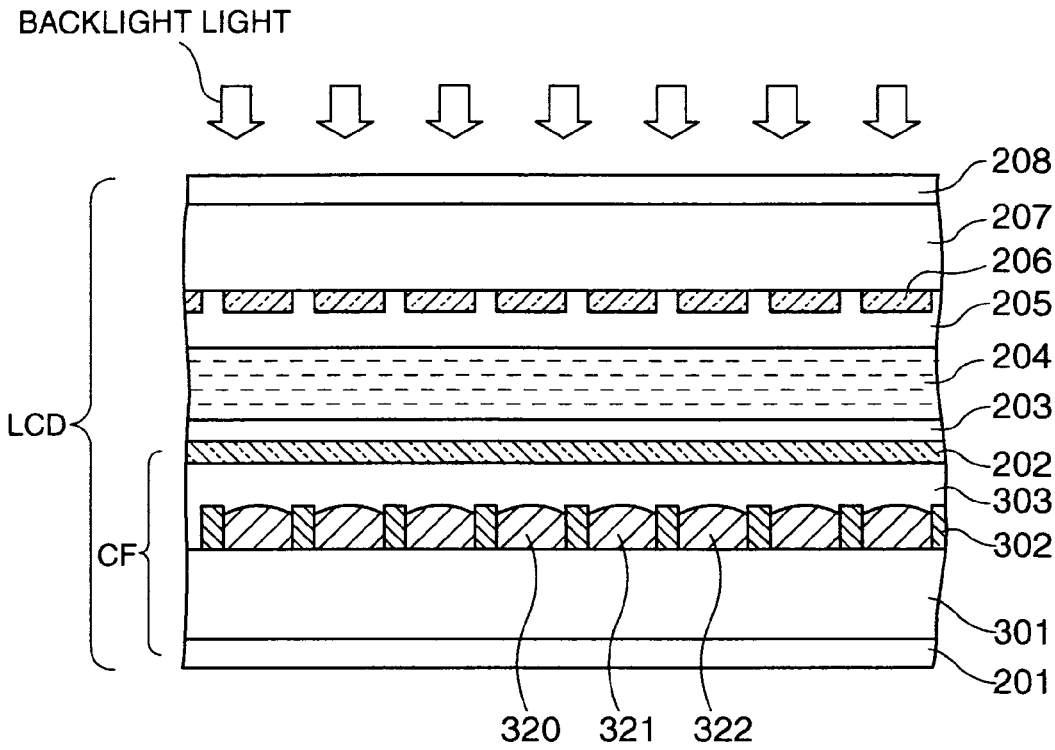
FIG. 12 shows an example of a device formed by the device manufacturing method of the present invention, FIG. 12 being a sectional view of a liquid crystal display having a color filter.

FIG. 12 is a sectional view showing an example of a portion of a liquid crystal display having a color filter, which is formed by the device manufacturing method according to the present invention.

Referring to FIG. 12, a liquid crystal display LCD has a color filter CF. The color filter CF can include a substrate 301 (P), a partition 302, different color pixel patterns 320, 321, and 322, and an overcoat 303 covering the pixel patterns. These components are laminated. Except the partition 302, each component has optically transparent properties. For the partition 302, either an optically transparent material or a light-shielding material can be used. The liquid crystal display LCD can further include a polarizer 201 disposed on the outer surface of the substrate 301, a common electrode 202, an alignment layer 203, a liquid crystal layer 204, an alignment layer 205, a pixel electrode 206, a substrate 207, and a polarizer 208. The components 202 to 207 are fundamentally laminated on the overcoat 303.

For a material for forming the substrate 301, when the material has heat-resistant properties overcoming heating conditions in the color filter manufacturing process and also has predetermined or higher mechanical strength, any proper optically transparent material can be used. The materials include, for example, glass, silicon, polycarbonate, polyester, aromatic polyamide, polyamide-imide, polyimide, norbornene-based open-ring polymer, and hydrogen adducts thereof. The substrate made of the above material can be subjected to proper pretreatment such as chemical treatment using silane coupler, plasma treatment, ion plating, sputtering, vapor phase reaction, or vacuum evaporation as necessary. These materials can also be used as the substrate 207. Different materials can be used for the respective substrates in some instances.

The partition 302 is made of a proper resin composition for partition formation. The partition 302 divides the surface of the substrate 301 into segments in a matrix form. Each segment serves as a light-transmitting area through which light transmits. The shape of each segment formed by the partition 302 can be changed as desired. For the resin composition used to form the partition 302, for example, the following compositions can be used: a radiation-sensitive resin composition containing a binder resin, a polyfunctional monomer, and a photopolymerization initiator, the resin composition capable of being cured by radiation exposure; and a radiation-sensitive resin composition containing a binder resin, a compound that generates acid by radiation exposure, a crosslinking compound that can be crosslinked by the effect of acid generated by radiation exposure, the resin composition capable of being cured by radiation exposure. When these radiation-sensitive resin compositions for partition formation are used, generally, a solvent is mixed to each composition to form a liquid composition. For the solvent, either a high-boiling solvent or a low-boiling solvent can be used.

The pixel pattern 320 can include a color-filter resin composition containing, for example, a red coloring agent. The pixel pattern 321 can have a color-filter resin composition containing, for example, a green coloring agent. The pixel pattern 322 has a color-filter resin composition containing, for instance, a blue coloring agent. These pixel patterns are formed by the foregoing ink-jet device IJ.

For a material for forming the overcoat 303, a general material used in the formation of a color-filter overcoat can be used. Preferably, a material that can be cured by the affect of light, heat, or both of light and heat is used because a general-purpose exposure system, a baking oven, or a hot plate can be used. The use results in a reduction in the equipment cost and a reduction in the space.

For the common electrode 202, an optically transparent and conductive material, for example, ITO (indium tin oxide) can be used. This material can be processed and formed by a conventional method. Each of the alignment layers 203 and 205 can be formed by rubbing a film made of a proper liquid crystal aligning material. These layers have properties of aligning liquid crystal molecules in a certain direction. The liquid crystal layer 204 comprises polarized liquid crystal molecules. The layer is formed so that the orientation of the liquid crystal molecules can be controlled by applying a voltage. The pixel electrode 206 is arranged so as to correspond to the respective pixel patterns of the color filter CF and is connected to an output terminal of driving means. The pixel electrode 206 is also made of an optically transparent and conductive material. For the material thereof, the same material as that of the common electrode 202 can be used. A material different from that of the common electrode 202 can be used in some cases. As the above driving means, for example, a TFT (thin film transistor) or a TFD (thin film diode) can be used. The polarizers 201 and 208 are adhered to the respective outer surfaces of the substrates 301 and 207, respectively. These polarizers permit the transmission of only specific polarized light among backlight falling on the rear of the liquid crystal display LCD. The two polarizers are arranged so that when a voltage is not applied to the liquid crystal layer 204, the polarizing direction of the light transmitted through each polarizer is deviated by a rotation angle of polarization given to the light through the liquid crystal molecules.

Figure 13:
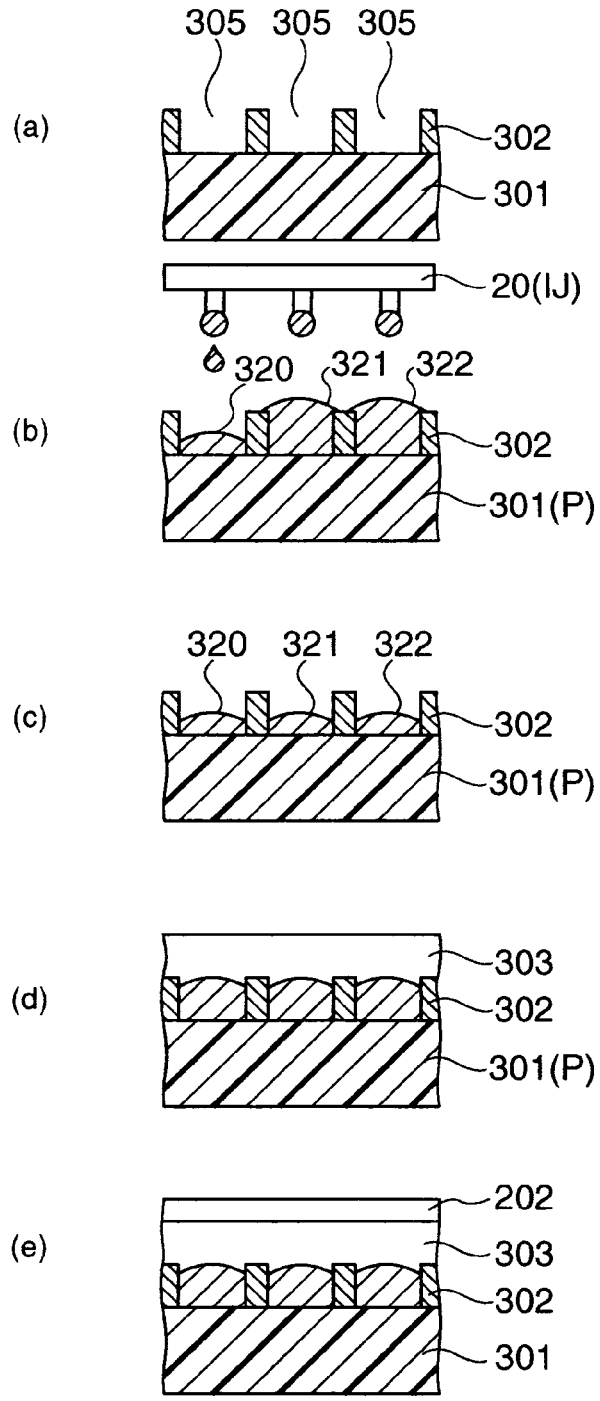
FIG. 13 includes diagrams showing color filter forming steps.

FIG. 13 includes diagrams showing the color-filter manufacturing process. Only the process of manufacturing the color filter CF of the liquid crystal display LCD will now be described.

The substrate 301 is coated with a solution of the radiation-sensitive resin composition for partition formation and is then pre-baked to evaporate the solvent, thus forming the film. After that, the film is exposed to radiation through a photomask, thus performing post exposure bake. Development is performed using an alkaline developer to dissolve and remove unexposed portions of the film. Thus, as shown in FIG. 13(*a*), the partition 302 forms partition patterns. The partition patterns each having a predetermined shape are arranged in accordance with a predetermined array. In this manner, the substrate 301 having thereon many light-transmitting areas 305, through which light transmits, is obtained.

Subsequently, as shown in FIG. 13(*b*), an ink-jet type color-filter resin composition is ejected from the ink-jet head 20 to the respective light-transmitting areas 305. At this time, the substrate 301 is supported on the stage ST of the ink-jet device IJ. Droplets are ejected onto the substrate 301 while the substrate is scanning the ink-jet head 20. The ink-jet head 20 ejects the droplets of the color-filter resin composition onto the substrate on the basis of the driving signal comprising the foregoing signal elements. The ink-jet head 20 allows the resin composition to be stored in the respective light-transmitting areas 305 so that the upper surface of the composition stored in each area protrudes higher than the upper end of the partition 302, thus forming resin-composition storage layers 321, 322, . . . Reference numeral 320 illustrates the state of the resin composition stored while the ejection is being performed.

After that, as shown in FIG. 13(*c*), the resin composition serving as the respective storage layers is subjected to heat treatment in order to evaporate the solvent, thus drying the resin composition. Consequently, the pixel patterns 320, 321, 322, . . . each having a predetermined thickness are formed. The volume of each storage layer is reduced by the above treatment. In this case, the heat treatment is performed using, for example, a heater under condition that the whole is heated at a predetermined temperature (for example, about 50° C.). After that, the resin composition may be irradiated with radiation as necessary. After that, in order to completely dry and crosslink the resin composition, the resin composition is heated for a predetermined period (for example, for about three minutes to two hours) at a predetermined temperature (for example, about 150 to 280° C.). In the formation of the pixel patterns 320, 321, 322, . . . , for instance, red, green, and blue resin compositions are sequentially used, so that an array including red, green, and blue pixels can be formed on the substrate 301.

After that, as shown in FIG. 13(*d*), in order to protect and flatten the surface of the color filter so as to cover the formed pixel patterns, the overcoat 303 is formed using a proper resin.

Furthermore, as shown in FIG. 13(*e*), the common electrode 202 is formed on the overcoat 303 using an optically transparent and conductive material (for example, ITO) using a method, such as a sputtering method or a vapor deposition method. When the common electrode 202 is patterned, the common electrode 202 is etched so as to correspond to the pattern of another component such as the pixel electrode 206. The color filter CF can be formed by the above respective processing steps.

In addition, the alignment layer 203, the liquid crystal layer 204, and the alignment layer 205 are sequentially formed between the color filter CF and the substrate 207 having the pixel electrode 206 thereon. The polarizers 201 and 208 are adhered onto the outer surfaces thereof, respectively. Thus, the liquid crystal display LCD is formed.

An example of an electronic device having the above-mentioned liquid crystal display LCD will now be described.

Figure 14:
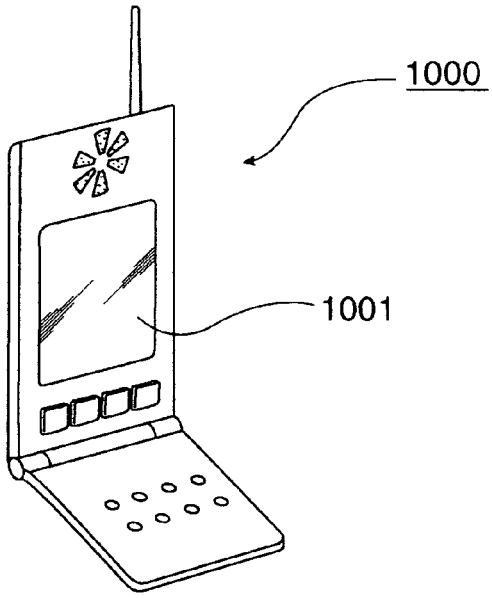
FIG. 14 is a diagram of an example of an electronic device having the device formed by the device manufacturing method of the present invention.

FIG. 14 is a perspective view of a cellular phone as an example. Referring to FIG. 14, reference numeral 1000 denotes a cellular phone body and reference numeral 1001 denotes a display unit using the foregoing liquid crystal display.

Figure 15:
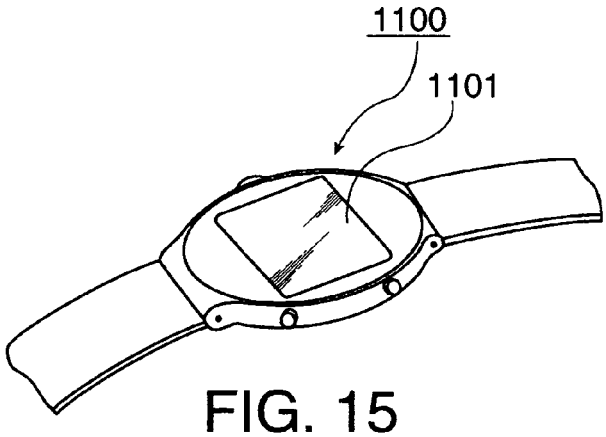
FIG. 15 is a diagram of an example of an electronic device having the device formed by the device manufacturing method of the present invention.

FIG. 15 is a perspective view of a wristwatch type electronic device as an example. Referring to FIG. 15, reference numeral 1100 denotes a watch body and reference numeral 1101 denotes a display unit using the above liquid crystal display.

Figure 16:
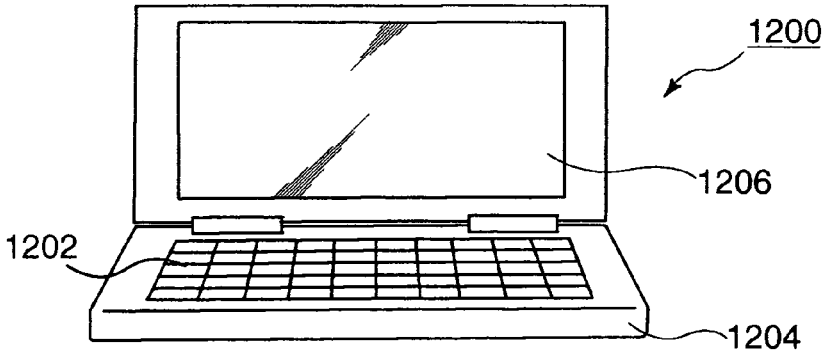
FIG. 16 is a diagram of an example of an electronic device having the device formed by the device manufacturing method of the present invention.

FIG. 16 is a perspective view of a portable information processing apparatus such as a word processor or a personal computer as an example. Referring to FIG. 16, reference numeral 1200 denotes an information processing apparatus, reference numeral 1202 denotes an input unit such as a keyboard, reference numeral 1204 denotes an information processing apparatus body, and reference numeral 1206 denotes a display unit using the foregoing liquid crystal display.

Since each of the electronic devices shown in FIGS. 14 to 16 includes the liquid crystal display according to the present embodiment, the electronic devices each having the low-cost liquid crystal display unit with excellent display quality can be realized.

According to the present embodiment, the device manufacturing method of the present invention is applied to the color filter of the liquid crystal display. However, it should be understood that the use of the device manufacturing method of the present invention can be not restricted to the above devices. When material layers for an organic electroluminescent device are formed, the device manufacturing method of the present invention can be used.

Examples, based on the device manufacturing method of the present invention, will now be described.

In an example of manufacturing a color filter using R (red), G (green), and B (blue) inks, the physical properties of the respective inks were as follows:

R ink Viscosity: 6.56 mPa.s, Surface tension: 31.1 mN/m
G ink Viscosity: 10.14 mPa.s, Surface tension: 31.8 mN/m
B ink Viscosity: 7.02 mPa.s, Surface tension: 27.9 mN/m The target value specifications were set as follows:

Head frequency: 28.8 kHz
Weight of ink droplet: 10 ng/Dot
Initial velocity of ink droplet from head: 7 to 8 m/s In order to deal with manufacture variations (variations in period TH) between heads, an extension of the duration Tc1 of the first charge signal element (1) was performed. When Tc1 was extended, the weight of the ink droplet was lower than 10 ng/Dot. Then, the medium potential VM was lowered, so that positive damping of the vibration of the meniscus based on the second charge signal element (3) was not performed. Thus, a decrease in the weight of the ink droplet was suppressed. At this time, frequency response in a rage of 1 to 30 kHz was preferable.

Under condition that Tc1=5.0 μsec, Th1=2.5 μsec, Td=3.0 μsec, Th2=3.5 μsec, Tc2=3.0 μsec, the ratio of the medium potential VM to V1 (=28.3V) upon ejection of the R ink was 15%, the ratio of the medium potential VM to V1 (=26.1V) upon ejection of the G ink was 10%, and the ratio of the medium potential VM to V1 (=24.7V) upon ejection of the B ink was 5%, values approaching to the target specifications could be obtained. The initial velocity of the ink droplet upon ejection of the R ink was 8.79 m/s, the initial velocity of the ink droplet ejection of the G ink was 8.15 m/s, and the initial velocity of the ink droplet upon ejection of the B ink was 8.43 m/s.

As described above, according to the present invention, the second signal element can be output in phase opposite to that of the residual vibration of each pressure generation chamber expanded based on the first signal element, and the third signal element can be output in phase opposite to that of the residual vibration of the pressure generation chamber contracted based on the second signal element. The sum of the expanding and contracting vibrations of the pressure generation chamber based on the three signal elements substantially equals zero. In other words, the first, second, and third signal elements are generated with such amplitudes and timings that the vibrations cancel each other out. Therefore, it is possible to effectively suppress the vibration of the meniscus in the nozzle opening corresponding to the pressure generation chamber. Thus, stable ejection can be realized.

While the meniscus of the liquid material in the pressure generation chamber is turning toward the nozzle opening, the second signal element is output to contract the pressure generation chamber. Consequently, a droplet can be ejected with a small driving amount using the vibration of the meniscus turning toward the nozzle opening. Therefore, if a liquid material has high viscosity, a droplet can be easily ejected from the nozzle opening by a predetermined amount with a relatively small driving amount.

The invention claimed is:

1. A device manufacturing apparatus comprising an inkjet device including a pressure generation chamber having a variable internal volume and a Helmholtz resonance frequency of a period TH, the device manufacturing apparatus comprising:

a nozzle opening connected with an inside of the pressure generation chamber;

a driving unit that causes the pressure generation chamber to expand and contract;

a control unit that generates a predetermined driving signal to the driving unit, the control unit generating:

a first signal element to cause the pressure generation chamber to expand;

a second signal element to cause the expanded pressure generation chamber to contract in order to eject a liquid material in the pressure generation chamber as a droplet from the nozzle opening;

a third signal element to cause the pressure generation chamber to expand to a state, which is held before the first signal element is output and after the ejection of the droplet, a first time which elapses between the beginning of output of the first signal element and the beginning of output of the second signal element being set so as to be substantially equivalent to the period TH, a second time which elapses between the beginning of output of the second signal element and the beginning of output of the third signal element being set so as to be substantially equivalent to the period TH, and a sum of an amplitude of the first signal element and an amplitude of the third signal element being set so as to be substantially equivalent to an amplitude of the second signal element;

a stage that supports a substrate onto which the droplet is ejected;

a first shifter that moveably supports the stage; and a second shifter that moveably supports the inkjet device, and is capable of rotating the inkjet device around a lateral direction of a base that supports the first shifter, and around a direction along a portion between a front portion and a back portion of the base.

2. The apparatus according to claim 1, the control unit outputting the second signal element when a meniscus of the liquid material in the pressure generation chamber turns toward the nozzle opening.

3. The apparatus according to claim 1, the control unit changing the duration of the third signal element.

4. The apparatus according to claim 1, the control unit changing an initial value of the third signal element.

5. The apparatus according to claim 1, the control unit changing the duration of the first signal element.

6. The apparatus according to claim 1, the driving unit having a piezoelectric vibrator.

7. The apparatus according to claim 6, the piezoelectric vibrator including a longitudinal-mode piezoelectric vibrator.

8. The apparatus according to claim 1, the inkjet device ejecting an electrooptic-device forming material.

9. The apparatus according to claim 1, the inkjet device ejecting a color-filter forming material.

10. A device manufacturing apparatus comprising an inkjet device including a pressure generation chamber having a variable internal volume and a Helmholtz resonance frequency of a period TH, the device manufacturing apparatus comprising:

a nozzle opening connected with an inside of the pressure generation chamber;

a driving unit that causes the pressure generation chamber to expand and contract;

a control unit to generate a predetermined driving signal to the driving unit, the control unit generating:

a first signal element to cause the pressure generation chamber to expand;

a second signal element to cause the expanded pressure generation chamber to contract in order to eject a liquid material in the pressure generation chamber as a droplet from the nozzle opening;

a third signal element to cause the pressure generation chamber to expand to a state, which is held before the first signal element is output and after the ejection of the droplet, a first time which elapses between the beginning of output of the first signal element and the beginning of output of the second signal element being set so as to be substantially equivalent to the period TH, a second time which elapses between the beginning of output of the second signal element and the beginning of output of the third signal element being set so as to be substantially equivalent to the period TH, and a duration of the first signal element, a duration of the second signal element, and a duration of the third signal element being set so as to be substantially equivalent to each other;

a stage that supports a substrate onto which the droplet is ejected;

a first shifter that moveably supports the stage;

and a second shifter that moveably supports the inkjet device, and is capable of rotating the inkjet device around a lateral direction of a base that supports the first shifter, and around a direction along a portion between a front portion and a back portion of the base.

11. The apparatus according to claim 10, the control unit outputting the second signal element as a meniscus of the liquid material in the pressure generation chamber turns toward the nozzle opening.

12. The apparatus according to claim 10, the control unit changing the duration of the third signal element.

13. The apparatus according to claim 10, the control unit changing an initial value of the third signal element.

14. The apparatus according to claim 10, the control unit changing the duration of the first signal element.

15. The apparatus according to claim 10, the driving unit having a piezoelectric vibrator.

16. The apparatus according to claim 15, the piezoelectric vibrator including a longitudinal-mode piezoelectric vibrator.

17. The apparatus according to claim 10, the inkjet device ejecting an electrooptic-device forming material.

18. The apparatus according to claim 10, the inkjet device ejecting a color-filter forming material.

* * * * *